US011269272B2

(12) United States Patent
Tatezawa et al.

(10) Patent No.: US 11,269,272 B2
(45) Date of Patent: Mar. 8, 2022

(54) FIXING DEVICE INCLUDING AN ENDLESS BELT FOR FIXING A TONER IMAGE ON A RECORDING MATERIAL

(71) Applicant: Canon Kabushiki Kaisha, Tokyo (JP)

(72) Inventors: Hidekazu Tatezawa, Saitama (JP); Youichi Chikugo, Chiba (JP); Rikiya Takemasa, Chiba (JP); Kenichi Tanaka, Ibaraki (JP); Yutaro Tsuno, Tokyo (JP); Mitsuru Hasegawa, Ibaraki (JP); Suguru Takeuchi, Chiba (JP); Hiroki Kawai, Chiba (JP); Yasuharu Toratani, Chiba (JP); Ayano Ogata, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/094,077

(22) Filed: Nov. 10, 2020

(65) Prior Publication Data

US 2021/0141322 A1 May 13, 2021

(30) Foreign Application Priority Data

Nov. 12, 2019 (JP) ..... JP2019204986
Nov. 12, 2019 (JP) ..... JP2019204987
Mar. 5, 2020 (JP) ..... JP2020037965

(51) Int. Cl.
*G03G 15/20* (2006.01)

(52) U.S. Cl.
CPC ..... *G03G 15/2017* (2013.01); *G03G 15/2064* (2013.01); *G03G 15/2057* (2013.01);
(Continued)

(58) Field of Classification Search
CPC ..... G03G 15/2017; G03G 15/2064; G03G 2215/2038
(Continued)

(56) References Cited

U.S. PATENT DOCUMENTS 5,873,020 A * 2/1999 Matsuura ..... G03G 15/2064 399/329
7,890,024 B2 2/2011 Hirayama et al. ..... 399/122
(Continued)

FOREIGN PATENT DOCUMENTS

JP 2003-195671 A 7/2003
JP 2004-004746 A 1/2004
(Continued)

OTHER PUBLICATIONS

U.S. Appl. No. 16/951,315, filed Nov. 18, 2020.
(Continued)

*Primary Examiner* — Robert B Beatty
(74) *Attorney, Agent, or Firm* — Venable LLP

(57) ABSTRACT

A fixing device includes a rotatable fixing belt, a pad, a rotatable pressing member, a pressing member driving source, an auxiliary driving roller, and a transmission mechanism for transmitting a driving force from the pressing member driving source to the auxiliary driving roller, wherein a peripheral speed of the auxiliary driving roller is faster than a peripheral speed of the pressing member, and a steering roller provided so as to stretch the fixing belt at the inner surface of the fixing belt in a position downstream of the auxiliary driving roller and upstream the pad with respect to a rotational direction of the fixing belt. The steering roller adjusts a position of the fixing belt with respect to a widthwise direction of the fixing belt by inclining the fixing belt so as to be positioned within a predetermined range.

24 Claims, 15 Drawing Sheets

(52) U.S. Cl.
CPC ..... *G03G 2215/2038* (2013.01); *G03G 2215/2048* (2013.01)

(58) Field of Classification Search
USPC ..... 399/329
See application file for complete search history.

(56) References Cited

U.S. PATENT DOCUMENTS

| | | | | |
|---|---|---|---|---|
| 7,890,038 | B2 | 2/2011 | Chikugo et al. | 399/323 |
| 8,005,414 | B2 | 8/2011 | Hasegawa | 399/331 |
| 8,655,242 | B2 | 2/2014 | Tanaka | 399/323 |
| 8,712,272 | B2 | 4/2014 | Takeuchi et al. | 399/69 |
| 8,818,254 | B2 | 8/2014 | Arimoto et al. | 399/329 |
| 8,862,009 | B2 | 10/2014 | Takeuchi et al. | 399/69 |
| 8,909,114 | B2 | 12/2014 | Takeuchi | 399/329 |
| 8,917,999 | B2 | 12/2014 | Takada et al. | 399/43 |
| 8,918,003 | B2 | 12/2014 | Kawai et al. | 399/69 |
| 8,929,762 | B2 | 1/2015 | Shinagawa et al. | 399/69 |
| 8,942,612 | B2 | 1/2015 | Tanaka | 399/330 |
| 8,971,746 | B2 | 3/2015 | Hasegawa et al. | 399/67 |
| 8,983,325 | B2 | 3/2015 | Takeuchi | 399/69 |
| 8,989,640 | B2 | 3/2015 | Kitagawa et al. | 399/320 |
| 9,026,020 | B2 | 5/2015 | Chikugo | 399/322 |
| 9,057,993 | B2 | 6/2015 | Takeuchi et al. | G03G 15/206 |
| 9,069,299 | B2 | 6/2015 | Tanaka | G03G 15/2028 |
| 9,235,168 | B2 | 1/2016 | Kawai | G03G 15/2053 |
| 9,274,467 | B2 | 3/2016 | Takeuchi et al. | G03G 15/2053 |
| 9,329,557 | B2 | 5/2016 | Kitagawa et al. | G03G 15/20 |
| 9,348,292 | B2 | 5/2016 | Chikugo | G03G 15/6573 |
| 9,354,562 | B2 | 5/2016 | Tanaka | G03G 15/2028 |
| 9,367,006 | B2 | 6/2016 | Yoshida et al. | G03G 15/2053 |
| 9,389,554 | B2 | 7/2016 | Tanaka et al. | G03G 15/2021 |
| 9,392,642 | B2 | 7/2016 | Tanaka et al. | H05B 1/00 |
| 9,465,336 | B2 | 10/2016 | Saito et al. | G03G 15/2053 |
| 9,547,262 | B2 | 1/2017 | Hirayama et al. | G03G 15/2039 |
| 9,563,163 | B2 | 2/2017 | Tanaka et al. | G03G 15/502 |
| 9,977,385 | B2 | 5/2018 | Miura et al. | G03G 15/2053 |
| 10,061,242 | B2 | 8/2018 | Tanaka | G03G 15/2032 |
| 10,133,219 | B2 | 11/2018 | Kawai | G03G 15/55 |
| 10,241,433 | B2 | 3/2019 | Tanaka et al. | G03G 13/20 |
| 10,241,455 | B2 | 3/2019 | Fukamachi et al. | G03G 15/2039 |
| 10,437,185 | B2 | 10/2019 | Yamaguchi et al. | G03G 15/5004 |
| 10,520,868 | B1 * | 12/2019 | Tomita | G03G 15/2064 |
| 10,564,576 | B2 | 2/2020 | Tanaka et al. | G03G 15/2053 |
| 10,627,751 | B2 | 4/2020 | Hasegawa et al. | G03G 15/2021 |
| 10,719,042 | B2 | 7/2020 | Hirayama et al. | G03G 15/2039 |
| 10,802,430 | B2 | 10/2020 | Toratani et al. | G03G 15/2053 |
| 2006/0083562 | A1 * | 4/2006 | Matsumoto | G03G 15/2064 399/329 |
| 2007/0071522 | A1 * | 3/2007 | Kaji | G03G 15/206 399/329 |
| 2008/0199232 | A1 * | 8/2008 | Takemura | G03G 15/2053 399/329 |
| 2010/0189477 | A1 * | 7/2010 | Yamada | G03G 15/2064 399/329 |
| 2011/0044737 | A1 * | 2/2011 | Takada | G03G 15/2025 399/329 |
| 2013/0142532 | A1 | 6/2013 | Kitagawa et al. | 399/67 |
| 2014/0348558 | A1 | 11/2014 | Inoue et al. | |
| 2015/0198920 | A1 | 7/2015 | Fukuhata et al. | |
| 2015/0273878 | A1 * | 10/2015 | Soda | B41J 11/005 347/104 |
| 2016/0139549 | A1 * | 5/2016 | Nozawa | G03G 15/2028 399/323 |
| 2017/0153581 | A1 | 6/2017 | Chikugo | G03G 15/20 |
| 2017/0192387 | A1 | 7/2017 | Tanaka | G03G 15/2039 |
| 2020/0041940 | A1 | 2/2020 | Kawai et al. | G03G 15/2017 |
| 2020/0133174 | A1 * | 4/2020 | Kawai | G03G 15/205 |
| 2020/0159153 | A1 | 5/2020 | Takemasa | G03G 15/2053 |
| 2020/0233353 | A1 | 7/2020 | Tsuno et al. | G03G 15/2053 |
| 2020/0233354 | A1 | 7/2020 | Tatezawa et al. | G03G 15/2064 |
| 2020/0310309 | A1 | 10/2020 | Kawai et al. | G03G 15/2039 |

FOREIGN PATENT DOCUMENTS

| | | | |
|---|---|---|---|
| JP | 2014-228765 | A | 12/2014 |
| JP | 2015-135354 | A | 7/2015 |
| JP | 2017-223800 | A | 12/2017 |

OTHER PUBLICATIONS

U.S. Appl. No. 17/123,793, filed Dec. 16, 2020.
U.S. Appl. No. 17/123,773, filed Dec. 16, 2020.
U.S. Appl. No. 17/160,062, filed Jan. 27, 2021.
U.S. Appl. No. 17/160,071, filed Jan. 27, 2021.

* cited by examiner

FIXING DEVICE INCLUDING AN ENDLESS BELT FOR FIXING A TONER IMAGE ON A RECORDING MATERIAL

FIELD OF THE INVENTION AND RELATED ART

The present invention relates to a fixing device for fixing a toner image, carried on a recording material, on the recording material.

As the fixing device, a constitution in which a nip in which the recording material is nipped and fed between a fixing belt which is an endless belt and a pressing roller contacting an outer peripheral surface of the fixing belt and in which the toner image is fixed on the recording material passing through the nip has been known (Japanese Laid-Open Patent Application (JP-A) 2014-228765). In the case of the constitution disclosed in JP-A 2014-228765, a driving force is imparted to the fixing belt by rotationally driving the pressing roller. In JP-A 2003-195671, JP-A 2004-4746, JP-A 2015-135354 and JP-A 2017-223800, in addition to the constitution in which the pressing roller is rotationally driven, a constitution in which an auxiliary driving roller stretches the fixing belt and enhances rotation stability of the fixing belt is disclosed. In the constitutions of JP-A 2003-195671, JP-A 2004-4746, JP-A 2015-135354 and JP-A 2017-223800, the fixing belt is stretched by the auxiliary driving roller and a fixing member or roller for forming a nip in which the recording material is nipped and fed.

On the other hand, as a constitution in which a shaft of the fixing belt is corrected so that the fixing belt falls within a predetermined range with respect to a widthwise direction of the fixing belt, there is a constitution in which a steering roller for inclining a rotational axis is used. There is liability that when a twist of the fixing belt with inclination of the steering roller reaches a downstream side of the nip with respect to a recording material feeding direction, stability in separation of the recording material from the nip lowers. On the other hand, the auxiliary driving roller is capable of eliminating a slack of a belt surface on a side upstream of the auxiliary driving roller with respect to the rotational direction of said fixing belt by the driving force. Therefore, when the auxiliary driving roller is disposed on a side upstream of the steering roller with respect to the rotational direction, stability of the belt surface on a side downstream of the nip can be enhanced.

SUMMARY OF THE INVENTION

A principal object of the present invention is to provide a fixing device for fixing a toner image on a recording material, comprising: a rotatable fixing belt configured to fix the toner image on the recording material in contact with the toner image formed on the recording material; a pad provided inside the fixing belt; a rotatable pressing member configured to press the fixing belt toward the pad so as to form a nip in which the recording material is nipped and fed; a driving source configured to impart a driving force, for rotating the fixing belt, to the pressing member; an auxiliary driving roller which is provided on a side downstream of the nip with respect to a rotational direction of the fixing belt and which stretches the fixing belt at an inner surface of the fixing belt, wherein the auxiliary driving roller is configured to impart a driving force to the fixing belt and is made of metal; a transmission mechanism configured to transmit the driving force from the driving source to the auxiliary driving roller, wherein a peripheral speed of the auxiliary driving roller is faster than a peripheral speed of the pressing member; and a steering roller provided so as to stretch the fixing belt at the inner surface of the fixing belt in a position downstream of the auxiliary driving roller and upstream the pad with respect to a rotational direction of the fixing belt, wherein the steering roller is configured to adjust a position of the fixing belt with respect to a widthwise direction of the fixing belt by inclining the fixing belt so as to be positioned within a predetermined range.

Further features of the present invention will become apparent from the following description of exemplary embodiments with reference to the attached drawings.

DESCRIPTION OF THE EMBODIMENTS

First Embodiment

Figure 1:
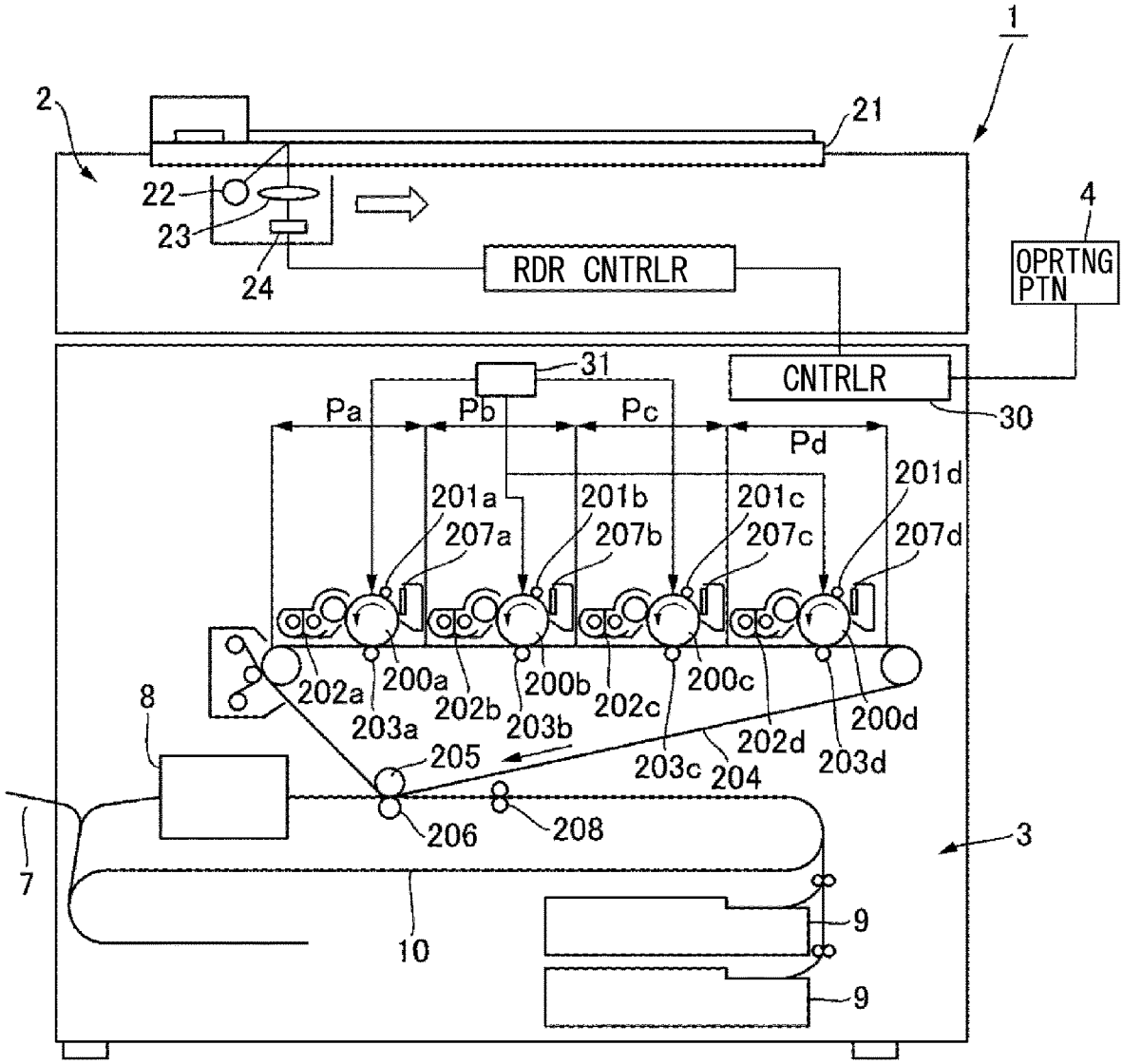
FIG. 1 is a schematic sectional view of an image forming apparatus in a first embodiment.

A first embodiment of the present invention will be described using FIGS. 1 to 4. First, a general structure of the image forming apparatus according to this embodiment will be described using FIG. 1.

[Image Forming Apparatus]

An image forming apparatus 1 is an electrophotographic full-color printer including four image forming portions Pa, Pb, Pc and Pd provided correspondingly to four colors of yellow, magenta, cyan and black. In this embodiment, the image forming apparatus 1 is of a tandem type in which the image forming portions Pa, Pb, Pc and Pd are disposed along a rotational direction of an intermediary transfer belt 204 described later. In this embodiment, the image forming apparatus 1 forms, on a recording material, a toner image (image) depending on an image signal from a host device, such as a personal computer, communicatably connected to an image forming apparatus main assembly 3 or an image reading portion (original reading device) 2 connected to the image forming apparatus main assembly 3. As the recording material, it is possible to cite a sheet material such as a sheet, a plastic film or a cloth.

The image forming apparatus 1 includes the image reading portion 2 and the image forming apparatus main assembly 3. The image reading portion reads an original placed on an original supporting platen glass 21, and light emitted from a light source 22 is reflected by the original and is formed in an image on a CCD sensor 24 through an optical system member 23 such as a lens. Such an optical system unit converts the original into an electric signal data stream (string) for each of lines by scanning the original with the light in an arrow direction. An image signal obtained by the CCD sensor 24 is sent to the image forming apparatus main assembly 3, and then subjected to image processing for an associated one of the image forming portions by a controller 30 as described later. Further, the controller 30 also receives external input as the image signal from an external host device such as a print server.

The image forming apparatus main assembly 3 include a plurality of image forming portions Pa, Pb, Pc and Pd, and in each of the image forming portions, image formation is carried out on the basis of the above-described image signal. That is, the image signal is converted into a laser beam subjected to PWM (pulse width modulation) control by the controller 30. A polygon scanner 31 as an exposure device scans each of photosensitive drum surfaces with the laser beam. Thus, photosensitive drums 200*a* to 200*d* as image bearing members of the respective image forming portions Pa to Pd are irradiated with the laser beams.

Incidentally Pa is the image forming portion for yellow (Y), Pb is the image forming portion for magenta (M), Pc is the image forming portion for cyan (C) and Pd is the image forming portion for black (Bk), and these portions form images of associated colors. The image forming portions Pa to Pd have the substantially same structure, and therefore, in the following, the image forming portion Pa for Y is described in detail and other image forming portions will be omitted from description. In the image forming portion Pa, on the surface of the photosensitive drum 200*a*, a toner image is formed on the basis of the image signal as described below.

A charging roller 201*a* as a primary charger electrically charges the surface of the photosensitive drum 200*a* to a predetermined potential to prepare for electrostatic latent image formation. An electrostatic latent image is formed on the surface of the photosensitive drum 200*a* charged to the predetermined potential, by irradiation with the laser beam from the polygon scanner 31. A developing device 202*a* develops the electrostatic latent image on the photosensitive drum 200*a*, so that the toner image is formed. A primary transfer roller 203*a* transfers the toner image from the photosensitive drum 200*a* onto the intermediary transfer belt 204 under application of a primary transfer bias of an opposite polarity to a charge polarity of toner by electrically discharging the intermediary transfer belt 204 from a back surface (side). The surface of the photosensitive drum 200*a* after the transfer is cleaned by a cleaner 207*a*.

Further, the toner image on the intermediary transfer belt 204 is fed to a subsequent image forming portion, so that in the order of Y, M, C and Bk, the respective color toner images successively formed in the associated image forming portions are transferred, and thus the four color toner images are formed on the surface of the intermediary transfer belt 204. Then, the toner images passed through the image forming portion Pd for Bk positioned on a most downstream side with respect to a rotational direction of the intermediary transfer belt 204 are fed to a secondary transfer portion constituted by a secondary transfer roller pair 205 and 206. Then, in the secondary transfer portion, the toner images are secondary-transferred from the intermediary transfer belt 204 onto the recording material under application of a secondary transfer electric field of an opposite polarity to the charge polarity of the toner images.

The recording material is accommodated in a cassette 9, and the recording material fed from the cassette 9 is fed to a registration portion 208 constituted by, for example, a pair of registration rollers and awaits at the registration portion 208. Thereafter, the registration portion 208 is subjected to timing control for aligning the toner images on the intermediary transfer belt 204 with the sheet (recording material), and then the recording material is fed to the secondary transfer portion.

The recording material on which the toner images are transferred at the secondary transfer portion is fed to a fixing device 8, in which the toner images are heated and pressed, so that the toner images carried on the recording material are fixed on the recording material. The recording material passed through the fixing device 8 is discharged onto a discharge tray 7. Incidentally, in the case where images are formed on double surfaces (sides) of the recording material, when transfer and fixation of the toner image onto a first surface (front surface) of the recording material are ended, the recording material is turned upside down by being fed through a reverse feeding portion 10, and transfer and fixation of the toner image onto a second surface (back surface) of the recording material are carried out, so that the recording material is stacked on the discharge tray 7.

Incidentally, the controller 30 carries out control of entirety of the image forming apparatus 1 as described above. Further, the controller 30 is capable of making various settings on the basis of input from an operating portion 4 of the image forming apparatus 1. Such a controller 30 includes a CPU (Central Processing Unit), a ROM (Read Only Memory) and a RAM (Random Access Memory). The CPU carries out control of respective portions while reading programs which are stored in the ROM and which correspond to control procedures. Further, in the RAM, operation data and input data are stored, and the CPU carries out the control by making reference to the data stored in the RAM, on the basis of the above-described programs or the like.

[Fixing Device]

Figure 2:
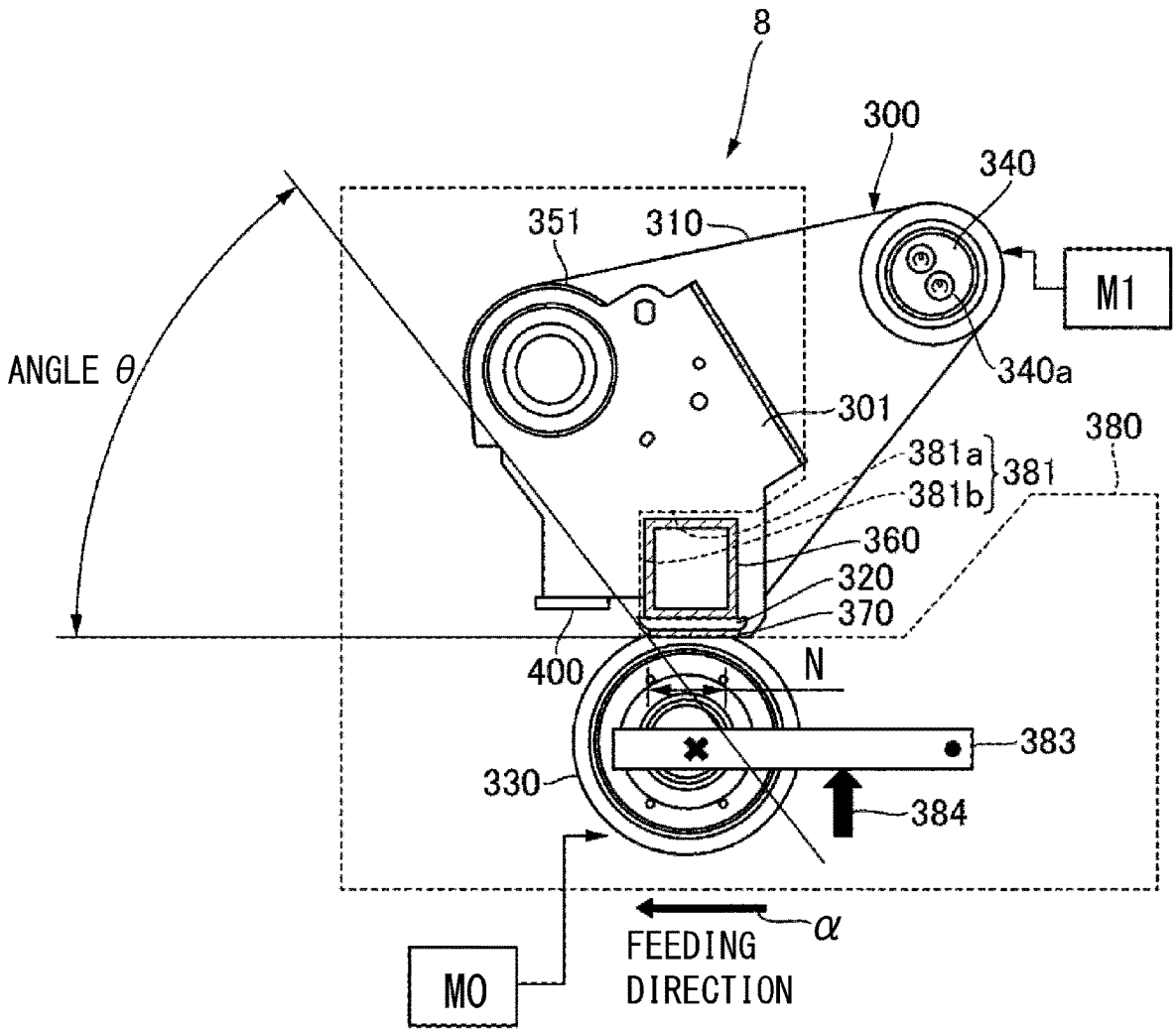
FIG. 2 is a schematic sectional view of a fixing device according to the first embodiment.

Next, a structure of the fixing device 8 in this embodiment will be described using FIG. 2. In this embodiment, a fixing device of a belt heating type using an endless belt is employed. In FIG. 2, the recording material is fed from a right to left direction as shown by an arrow a. The fixing device 8 includes a heating unit 300 including a fixing belt as an endless and rotatable belt and a pressing roller 330 as a rotatable pressing member (pressing member), contacting the fixing belt 310, for forming a nip in cooperation with the fixing belt 310.

The heating unit 300 includes the above-described fixing belt 310, a fixing pad 320 as a nip forming member and a stretching member (pressing pad), an auxiliary driving roller 340 as a driving roller, and a stretching roller 351 as a stretching member. The pressing roller 330 rotates in contact with an outer peripheral surface of the fixing belt 310 and is also rotatable driving member for imparting a driving force to the fixing belt 310.

The fixing belt 310 which is an endless belt has a heat conductive property, a heat resistant property and the like, and has a thin cylindrical shape with an inner diameter of 120 mm, for example. In this embodiment, the fixing belt 310 has a three-layers structure consisting of a base layer, an elastic layer formed on an outer peripheral surface of the base layer, and a parting layer formed on an outer peripheral surface of the elastic layer. The base layer is 60 μm in thickness and a polyimide (PI) resin material is used. The elastic layer is 300 μm in thickness and a silicone rubber material is used. The parting layer is 30 μm in thickness and PFA (polytetrafluoroethylene-perfluoroalkoxyethylene copolymer) resin material is used. Such a fixing belt 310 is stretched by the fixing pad 320, the auxiliary driving roller 340 and the stretching roller 351.

The fixing pad 320 as the nip forming member is not only disposed inside the fixing belt 310 so as to oppose the pressing roller 330 through the fixing belt 310, but also forms a nip N in which the recording material is nipped and fed between the fixing belt 310 and the pressing roller 330. In this embodiment, the fixing pad 320 is a substantially plate-like member long along a widthwise direction (rotational axis direction of the auxiliary driving roller 340) of the fixing belt 310. The fixing pad 320 is pressed against the fixing belt 310 toward the pressing roller 330, so that the nip N is formed. As a material of the fixing belt 320, an LCP (liquid crystal polymer) is used.

The fixing pad 320 is supported by a stay 360 provided inside the fixing belt 310. The stay 360 is a reinforcing member which is long along the widthwise direction of the fixing belt 310 and which has rigidity. The stay 360 imparts strength to the fixing pad 320 and ensures a pressing force in the nip N when the fixing pad 320 is pressed by the pressing roller 330.

Figure 3:
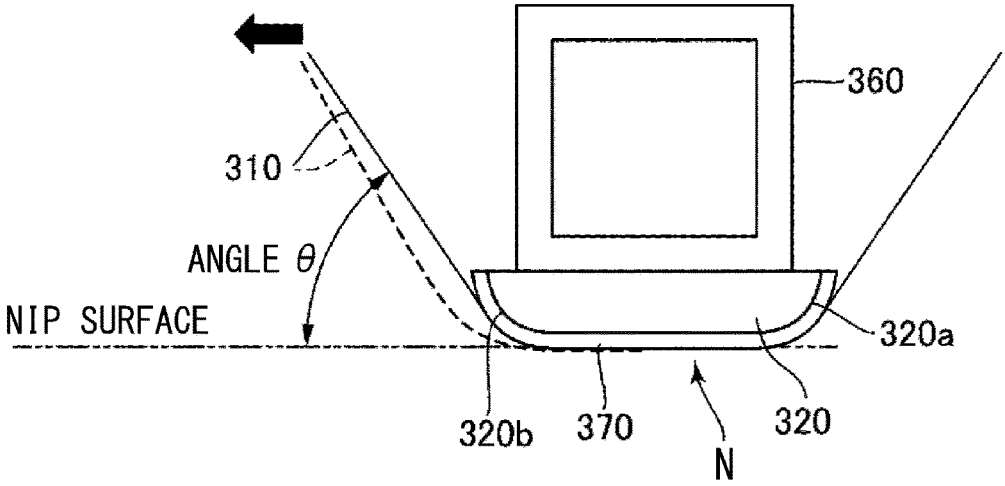
FIG. 3 is a schematic view for illustrating a locus of a fixing belt on a side downstream of a fixing pad.

Further, as shown in FIG. 3, opposite end portions of the fixing pad 320 with respect to a recording material feeding direction in the nip N are curved surface shape portions 310*a* and 320*b*, respectively. Each of the curved surface shape portions 320*a* and 320*b* has a curved surface curved from a nip surface toward the end portion in a direction (upward in FIG. 3) of moving away from the nip surface. The nip surface is a surface along a surface (lower surface of FIG. 3) of the fixing pad 320 on the pressing roller 330 side. Further, in this embodiment, the upstream curved surface shape portion 320*a* is a partially cylindrical surface of 8 mm in radius, and the downstream curved surface shape portion 320*b* is a partially cylindrical surface of 6 mm in diameter. That is, a radius of curvature of the downstream curved surface shape portion 320*b* is made smaller than a various of curvature of the upstream curved surface shape portion 320*a*.

Thus, in this embodiment, the downstream end portion of the fixing pad 320 is the curved surface shape portion 320*b*, and the fixing belt 310 is curved by the curvature of the curved surface shape portion 320*b*. Further, the recording material passed through the nip N is separated from the fixing belt 310 by the curvature of the fixing belt 310.

Between the fixing pad 320 and the fixing belt 310, a lubrication sheet 370 is interposed. In this embodiment, as the lubrication sheet 370, a PI (polyimide) sheet coated with PTFE (polytetrafluoroethylene) is used, and a thickness thereof is 100 μm. The PI sheet is provided with projections of 100 μm formed with an interval of 1 mm, so that a contact area with the fixing belt 310 is reduced and thus a sliding resistance is decreased.

Further, onto an inner peripheral surface of the fixing belt 310, a lubricant is applied, so that the fixing belt 310 smoothly slides on the lubrication sheet 370 covering the fixing pad 320. As the lubricant, silicone oil of 100 cSt in viscosity is used. Incidentally, in this embodiment, as the nip forming member, the fixing pad 320 which is a non-rotatable member which is not rotated even when the fixing belt 310 rotates is used, but a rotatable member such as a roller may also be used.

As shown in FIG. 2, the auxiliary driving roller 340 is disposed inside the fixing belt 310 and rotates while stretching the fixing belt 310 in cooperation with the fixing pad 320, and imparts a driving force to the fixing belt 310. The auxiliary driving roller 340 is formed of metal such as aluminum or stainless steel in a cylindrical shape, and in which a halogen heater 340*a* as a heating source for heating the fixing belt 310 is provided. Further, the auxiliary driving roller 340 is heated up to a predetermined temperature by the halogen heater 340*a*.

In this embodiment, from a viewpoint of thermal conductivity, the auxiliary driving roller 340 is formed with, for example, an aluminum pipe of 40 mm in outer diameter and 1 mm in thickness, and a surface layer thereof is subjected to anodization (alumite) treatment. Further, the halogen heater 340*a* may also be a single heater, but when temperature distribution of the auxiliary driving roller 340 with respect to a longitudinal direction (rotational axis direction) is taken into consideration, a plurality of halogen heaters 340*a* may desirably be used. The halogen heaters 340*a* provided in plurality have light distribution different from each other with respect to the longitudinal direction, and a lighting ratio is controlled depending on a size of the recording material. In this embodiment, two halogen heaters 340*a* are disposed. Incidentally, the heating source is not limited to the halogen heater, but may also be another heater, such as a carbon heater, capable of heating the auxiliary driving roller 340.

The fixing belt 310 is heated by the auxiliary driving roller 340 heated by the halogen heater 340*a* and is controlled at a predetermined target temperature depending on a kind of the recording material, on the basis of temperature detection by an unshown thermistor. Further, the auxiliary driving roller is fixed by a gear at one end portion thereof with respect to the rotational axis direction, and is connected to a motor M1 as an auxiliary driving roller driving source (second driving source) through the gear and thus is rotationally driven. Further, to the fixing belt 310, a driving force is imparted by the rotation of the auxiliary driving roller 340. Here, a force applied from the auxiliary driving roller 340 to the fixing belt 310 is referred to as an auxiliary driving force.

Incidentally, as regards the rotation of the auxiliary driving roller 340, a rotational driving force may also be applied from a motor M0 as a pressing roller driving source (first driving source) for rotationally driving the pressing roller 330 and may also be applied from the motor M1 different from the motor M0. Further, a drive transmission mechanism from the motor may also be another mechanism, such as a pulley and a belt, other than the gear, or a mechanism in which a roller driven by a motor is externally pressed against the auxiliary driving roller 340.

The stretching roller 351 is disposed inside the fixing belt 310 and stretches the fixing belt 310 in cooperation with the fixing device 320 and the auxiliary driving roller 340, and is rotated by the fixing belt 310. In this embodiment, with respect to the rotational direction of the fixing belt 310, the fixing pad 320, the stretching roller 351 and the auxiliary driving roller 340 are disposed in a named order. The stretching roller 351 is formed of metal such as aluminum or stainless steel in a cylindrical shape. In this embodiment, the stretching roller 351 is a stainless steel or aluminum pipe of 40 mm in outer diameter and 1 mm in thickness, and end portions thereof are rotationally supported by unshown bearings.

Further, in this embodiment, the stretching roller 351 is urged by a spring supported by a frame of the heating unit 300 and is also a tension roller for applying predetermined tension to the fixing belt 310. The tension by the spring is 50 N in this embodiment. By applying the tension to the fixing belt 310 by the stretching roller 351 in such a manner, the fixing belt 310 is caused to follow the curved surface shape portions 320*a* and 320*b* of the fixing pad 320. That is, the fixing belt 310 is curved along the curved surface shape portions 320*a* and 320*b*.

The pressing roller 330 as a rotatable driving member rotates in contact with the outer peripheral surface of the fixing belt 310 and imparts the driving force to the fixing belt 310. In this embodiment, the pressing roller 330 is a roller in which an elastic layer is formed on an outer peripheral surface of a shaft and a parting layer is formed on an outer peripheral surface of the electric layer. Further, the shaft is formed of stainless steel. The elastic layer is 5 mm in thickness and is formed of an electroconductive silicone rubber. The parting layer is 50 μm in thickness and is formed of PFA (tetrafluoroethylene-perfluoroalkoxyethylene copolymer). The pressing roller 330 is rotatably supported by a fixing (device) frame 380 of the fixing device 8 and is fixed by a gear at one end portion, and is connected to the motor M0 as the pressing roller driving source (first driving source) through the gear, and thus is rotationally driven.

The fixing frame 380 is provided with a heating unit positioning portion 381, a pressing frame 383 and a pressing spring 384. The heating unit 300 is positioned relative to the fixing frame 380 by inserting the stay 360 into the heating unit positioning portion 381 and then by fixing the stay 360 to the heating unit positioning portion 381 by an unshown fixing means. Here, the heating unit positioning portion 381 includes a driving direction restriction surface 381*a* opposing the pressing roller 330 and a feeding direction restriction surface 381*b* which is an abutment surface with respect to an insertion direction of the heating unit 300. The stay 360 is fixed in a state movement thereof toward the pressing direction restriction surface 381*a* and the feeding direction restriction surface 318*b*. At this time, the pressing roller 330 is spaced from the fixing belt 310.

After the heating unit 300 is positioned relative to the heating unit positioning portion 381, the pressing roller 330 is contacted to the fixing belt 310 by moving a pressing frame 383 by an unshown driving source and a cam. Then, the pressing roller 330 is pressed against the fixing belt 310 toward the fixing pad 320. In this embodiment, a pressing force during the image formation is 1000 N.

Further, in the case of this embodiment, on a side downstream of the nip N with respect to the recording material feeding direction, a separation member 400 for separating the recording material from the fixing belt 310 is provided. The separation member 400 is disposed with a gap from the outer peripheral surface of the fixing belt 310 and separates the recording material passed through the nip N. Specifically, the separation member 400 is disposed close to a portion, of the outer peripheral surface of the fixing belt 310, stretched between the fixing pad 320 and the stretching roller 351. Further, the separation member 400 is formed in a blade shape, and a free end thereof is opposed to the outer peripheral surface of the fixing belt 310.

The thus-constituted fixing device 8 heats the toner image while nipping and feeding the recording material on which the toner image is carried, in the nip N formed between the fixing belt 310 and the pressing roller 330. By this, the toner image is melted and the toner image is fixed on the recording material. In the case of this embodiment, during the image formation, a peripheral speed of the fixing belt 310 is 300 mm/s, a pressing force in the nip N is 1000 N, and a temperature of the fixing belt 310 is 180° C.

[Followability of Fixing Belt to Curved Surface Shape Portion of Fixing Pad]

As shown in FIG. 2, in the constitution of this embodiment, an angle θ between the nip surface and a locus of the fixing belt 310 from the nip N to the stretching roller 351 is 52°. Here, in the case rigidity of the fixing belt 310 is small and tension applied to the fixing belt 310 is sufficiently large, a locus in the neighborhood of an outlet (on a side downstream of the nip N with respect to the recording material feeding direction) of the nip N of the fixing belt 310 is as shown by a solid line in FIG. 3. However, by the rigidity of the fixing belt 310 and the force received by the fixing belt 310 in the nip N, there is a liability that the locus of the fixing belt 310 in the neighborhood of the outlet of the nip N during the image formation expands as shown by a broken line of FIG. 3.

That is, the fixing belt 310 receives the rotational driving force from the pressing roller 330. For this reason, if in the case where the above-described auxiliary driving roller 340 is a roller which does not impart the driving force to the fixing belt 310, there is a liability that the fixing belt 310 is flexed by the driving force of the pressing roller 330 in the neighborhood of the outlet of the nip N. In this case, followability of the fixing belt 310 to the curvature of the curved surface shape portion 320*b* at the downstream end portion of the fixing pad 320 lowers, so that the fixing belt 310 is not sufficiently curved at the outlet of the nip N, and thus the locus of the fixing belt 310 expands as indicated by the broken line of FIG. 3.

In this way, when the locus of the fixing belt 310 expands in the neighborhood of the outlet of the nip N, a separation property of the recording material from the fixing belt 310 lowers. Further, there is also a possibility that the fixing belt 310 and the separation member 400 disposed close to the fixing belt 310 contact each other. When the fixing belt 310 contacts the separation member 400, there is a liability that the surface of the fixing belt 310 is scarred and a quality of the toner image fixed by the fixing device 8 lowers.

As a solution for solving such a problem, it would be considered that the tension of the fixing belt 310 is made large. However, in the case where the tension of the fixing belt 310 is made large, there is a liability that an adverse effect such as creep deformation of the base layer of the fixing belt 310 is caused.

Therefore, in this embodiment, as described above, the auxiliary driving roller 340 which is disposed inside the fixing belt 310 and which imparts (applies) the driving force to the fixing belt 310 is provided. Particularly, in this embodiment, a peripheral speed of the auxiliary driving roller 340 is made faster than a peripheral speed of the pressing roller 330. By this constitution, the driving force is applied to the auxiliary driving roller 340, so that the auxiliary driving roller 340 pulls the belt surface on a side upstream of the auxiliary driving roller 340 with respect to the rotational direction of the fixing belt 310. As a result, with respect to the rotational direction of the fixing belt 310, the belt surface positioned on a side upstream of the auxiliary driving roller 340 and downstream of the nip N is pulled by the auxiliary driving roller 340. As a result, a degree of expansion of the locus of the fixing belt 310 in the neighborhood of the outlet of the nip N can be made small.

By imparting the driving force to the fixing belt 310 by the auxiliary driving roller 340, followability of the fixing belt 310 can be improved. Further, the followability of the fixing belt 310 can be further improved by making the peripheral speed of the auxiliary driving roller 340 faster than the peripheral speed of the pressing roller 330.

Further, by providing the auxiliary driving roller 340, an effect was also achieved on image deviation. The fixing belt 310 is rotated by being supplied with the force from the pressing roller 330, but at that time, by a sliding resistance of the fixing belt 310 with the fixing pad 320, the fixing belt 310 is fed while being slightly shifted from the recording material passing through the nip N. On the other hand, an auxiliary driving force is applied to the fixing belt 310 from an inner surface side of the fixing belt 310 by the auxiliary driving roller 340, the fixing belt 310 receives not only the driving force from the pressing roller 330 but also the driving force from the auxiliary driving roller 340. For that reason, even in a constitution in which the fixing pad 320 increases a load of rotation of the fixing belt 310, the fixing belt 310 always receives the driving force from the auxiliary driving roller 340 irrespective of whether the recording material is present or absent in the nip N. As a result, not only in the case where the recording material is absent in the nip N but also even in the case where the recording material is present in the nip N, the peripheral speed of the pressing roller 330 and the peripheral speed of the fixing belt 310 can be made substantially equal to each other. That is, rotation stability of the fixing belt 310 can be enhanced.

Specifically, the fixing belt 310 is nipped in the nip at high pressure between the pressing roller 330 and the fixing pad 320. The auxiliary driving roller 340 is constituted so that the fixing belt 310 is rotated by a frictional force, and therefore, a driving force for moving the fixing belt 310 at a peripheral speed faster than the peripheral speed of the pressing roller 330 against the high pressure cannot be transmitted. For that reason, in the case where the recording material is absent in the nip, the fixing belt 310 and the pressing roller 330 move at the same peripheral speed in the nip. At that time, the fixing belt 310 is low in elastic modulus with respect to a circumferential direction thereof, so that the auxiliary driving roller 340 rotates so as to slide on the fixing belt 310. By such an operation, the peripheral speed of the fixing belt 310 and the peripheral speed of the pressing roller 330 are substantially the same. On the other hand, also in the case where the recording material is present in the nip, for the same reason, the fixing belt 310 receives the driving force of the auxiliary driving roller 340 and the driving force of the pressing roller 330, so that the peripheral speed of the fixing belt 310 and the peripheral speed of the pressing roller 330 can be made substantially the same. Further, a feeding speed of the recording material, the peripheral speed of the fixing belt 310 and the peripheral speed of the pressing roller 330 can be made substantially the same. As a result, it turned out that a degree of deviation of the fixing belt 310 from the recording material can be alleviated and an effect of suppressing image deviation is also achieved. Thus, the peripheral speed of the auxiliary driving roller 340 is set so that the peripheral speed of the fixing belt 310 and the peripheral speed of the pressing roller 330 are the substantially same. Here, the substantially same refers to that a speed difference is within ±5%.

In order to achieve the above-described effects, it is preferable that the relationship of: 1.03≤(peripheral speed of auxiliary driving roller 340)/(peripheral speed of pressing roller 330)≤1.20 is satisfied. Further, in order to improve the image quality, the relationship of: 1.03≤(peripheral speed of auxiliary driving roller 340)/(disposed of pressing roller 330)≤1.10 may preferably be satisfied.

[Thermal Efficiency of Auxiliary Driving Roller]

As described above, inside the auxiliary driving roller 340, the halogen heater **340*a* as the heating source for heating the fixing belt 310 is disposed. Here, the auxiliary driving roller 340 rotates at a speed faster than a speed of the fixing belt 310. For that reason, compared with the case where the auxiliary driving roller 340 is rotated by the fixing belt 310 at the same speed, a heat transfer nip can be virtually extended. In other words, compared with the auxiliary driving roller 340 is rotated by the fixing belt 310 at the same speed, a contact time between the auxiliary driving roller 340 and the fixing belt 310 can be made long. For this reason, by rotating the auxiliary driving roller 340 at the peripheral speed faster than the peripheral speed of the fixing belt 310, heat transfer efficiency from the auxiliary driving roller 340 to the fixing belt 310 can be made better than the case where the auxiliary driving roller 340 is rotated by the fixing belt 310** at the same speed.

[Durability of Auxiliary Driving Roller Surface Layer]

As described above, the belt followability is improved by making the peripheral speed of the auxiliary driving roller 340 faster than the peripheral speed of 300 mm/s of the fixing belt 310. However, the auxiliary driving force is imparted to the fixing belt 310 by intentionally making the peripheral speed of the auxiliary driving roller 340 faster than the peripheral speed of the fixing belt 310, and therefore, the outer peripheral surface of the auxiliary driving roller 340 and the inner peripheral surface of the fixing belt 310 rub against each other. As described above, the auxiliary driving roller 340 is made of aluminum from the viewpoint of thermal conductivity, and therefore, it would be considered that the outer peripheral surface of the auxiliary driving roller 340 is abraded by the rubbing. For this reason, the surface layer of the auxiliary driving roller 340 may preferably be subjected to anodization (alumite) treatment.

[Winding Amount of Fixing Belt]

Figure 4:
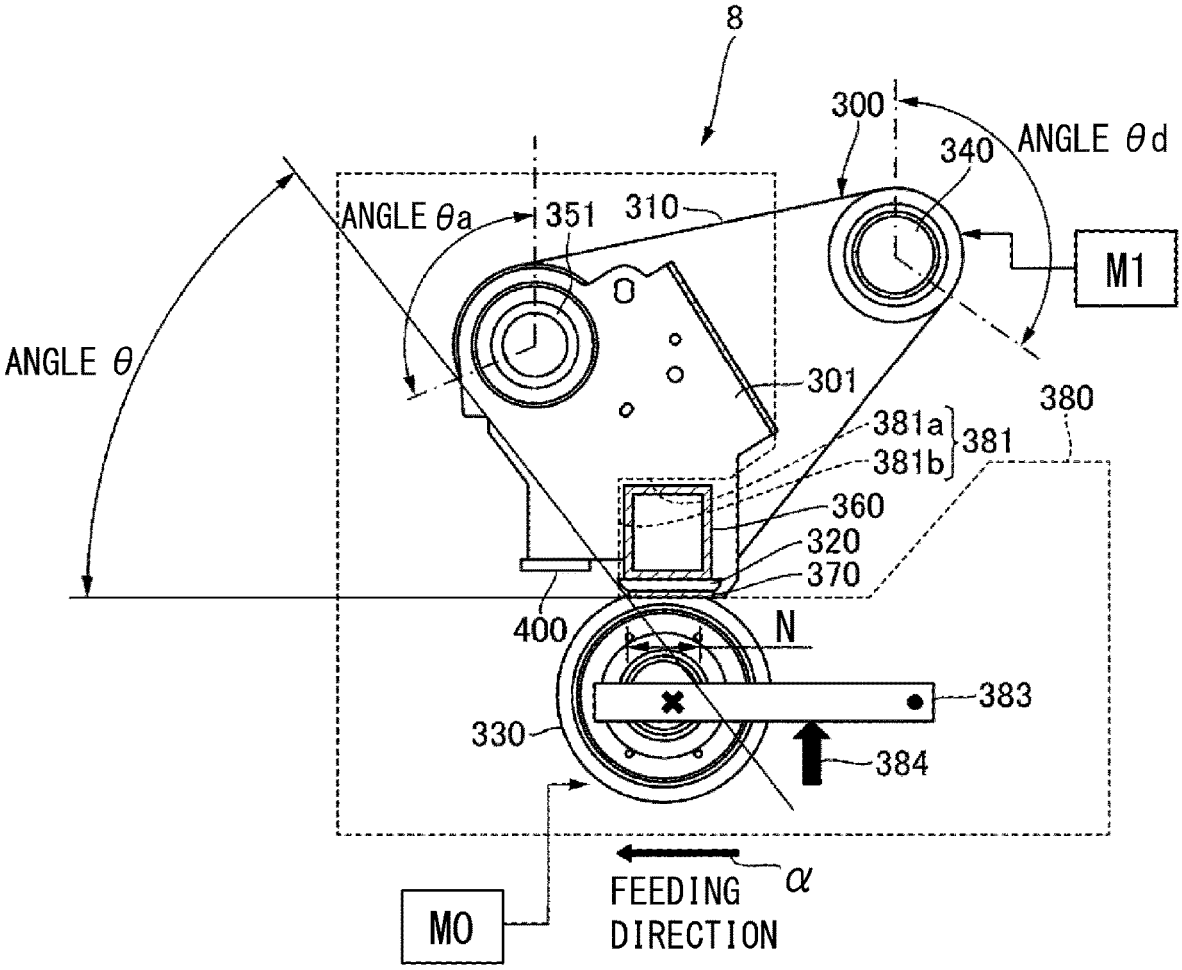
FIG. 4 is a schematic sectional view of the fixing device for illustrating a relationship between a winding amount of the fixing belt about a roller for stretching the fixing belt and a winding amount of the fixing belt about another roller for stretching the fixing belt in the first embodiment.

A winding amount of the fixing belt about the respective rollers will be described using FIG. 4. Here, the winding amount of the belt refers to a length of the belt wound about the roller and further refers to a length of the belt contacting the roller. Incidentally, FIG. 4 is the same as FIG. 2 in structure itself, and in which only angles θa and θd are added to FIG. 2. However, in FIG. 5, the halogen heaters **340*a*** are omitted from illustration.

As shown in FIG. 4, an angle formed on the basis of a roller center by winding the fixing belt 310 about the auxiliary driving roller 340 is a winding angle θd. Further, an angle formed on the basis of a roller center by winding the fixing belt 310 about the stretching roller 351 is a winding angle θa. Incidentally, the winding angle refers to an angle formed by lines each connecting the roller center and an associated end of a range in which the belt contacts the roller with respect to a circumferential direction of the roller.

In this embodiment, the winding angle θd of the fixing belt 310 about the auxiliary driving roller 340 is made larger than the winding angle θa of the fixing belt 310 about the stretching roller 351. Specifically, the winding angle θd is 120°, and the winding angle θa is 100°. Further, by making the winding angle θd larger than the winding angle θa in this manner, a winding amount of the fixing belt 310 about the auxiliary driving roller 340 is made larger than a winding amount of the fixing belt 310 about the stretching roller 351.

Here, even when the winding angle θd is simply made larger than the winding angle θa, if a cross-sectional area of the auxiliary driving roller 340 is excessively smaller than a cross-sectional area of the stretching roller 351, the winding amount of the fixing belt 310 about the auxiliary driving roller 340 cannot be made larger than the winding amount of the fixing belt 310 about the stretching roller 351. For this reason, in this embodiment, for example, the cross-sectional areas, in other words, outer diameters of the auxiliary driving roller 340 and the stretching roller 351 are made substantially the same, so that the winding amount of the fixing belt 310 about the auxiliary driving roller 340 is made larger than the winding amount of the fixing belt 310 about the stretching roller 351. Incidentally, when the winding amounts satisfy this relationship, the cross-sectional area of the auxiliary driving roller 340 may also be smaller than the cross-sectional area of the stretching roller 351. The cross-sectional area of the auxiliary driving roller 340 may also be larger than the cross-sectional area of the cross-sectional area of the stretching roller 351.

Thus, by making the winding amount of the fixing belt 310 about the auxiliary driving roller 340 large, the contact area between the auxiliary driving roller 340 and the fixing belt 310 can be made large, so that transfer efficiency of the driving force from the auxiliary driving roller 340 to the fixing belt 310 can be improved. Further, in the case where the heating source such as the halogen heater 340*a* is provided inside the auxiliary driving roller 340, heat transfer efficiency from the auxiliary driving roller 340 to the fixing belt 310 can also be improved. Incidentally, the winding amount of the fixing belt 310 about the auxiliary driving roller 340 may also be made larger than a winding amount of the fixing belt 310 about the fixing pad 320. That is, the winding amount of the fixing belt 310 about the auxiliary driving roller 340 may also be made largest between all the members stretching the fixing belt 310 from the inside of the fixing belt 310.

As described above, in this embodiment, by providing the auxiliary driving roller 340, the belt followability can be improved. As a result, a lowering in separation property of the recording material, passing through the nip N, from the fixing belt 310 can be suppressed. Further, the separation member 400 is disposed with the gap from the fixing belt 310. This gap is set at a small value in order to separate the recording material from the fixing belt 310. For this reason, when the belt followability lowers and the locus of the fixing belt 310 expands in the neighborhood of the outlet of the nip N, there is a liability that the fixing belt 310 contacts the separation member 400 and thus is damaged (scarred). On the other hand, in this embodiment, by providing the auxiliary driving roller 340, the belt followability can be improved, so that the fixing belt 310 can be caused to less contact the separation member 400.

Second Embodiment

Figure 6:
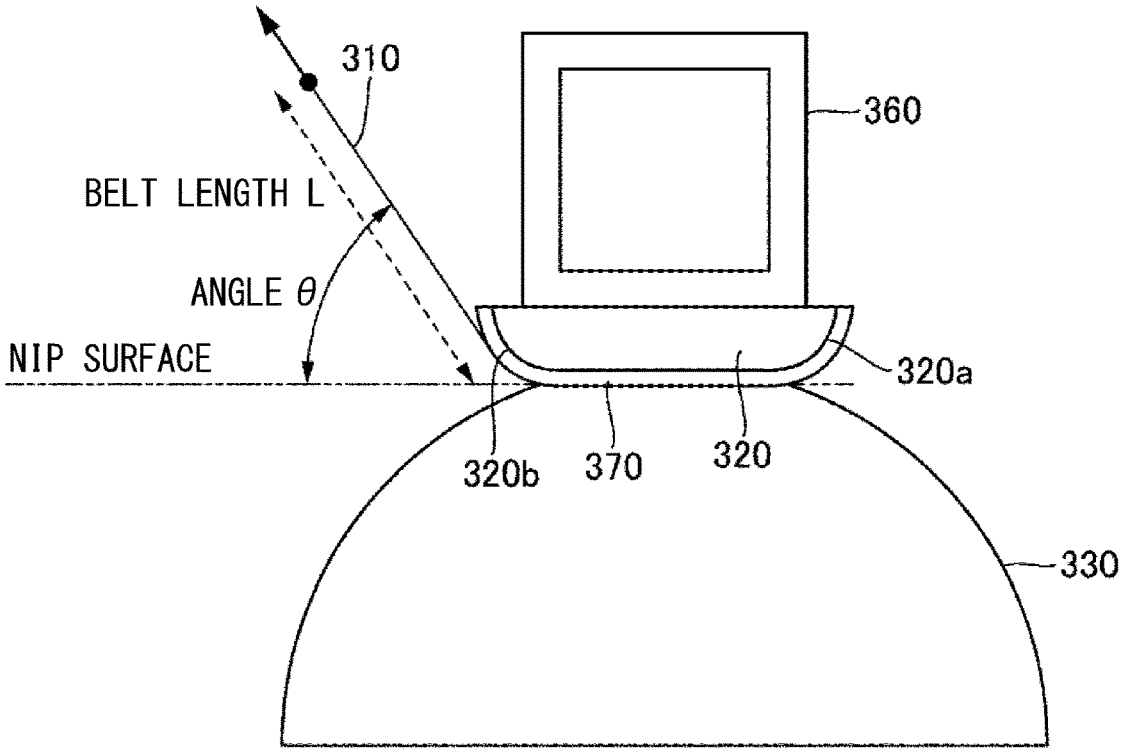
FIG. 6 is a schematic view for illustrating a belt length L on a side downstream of a fixing pad.
Figure 7:
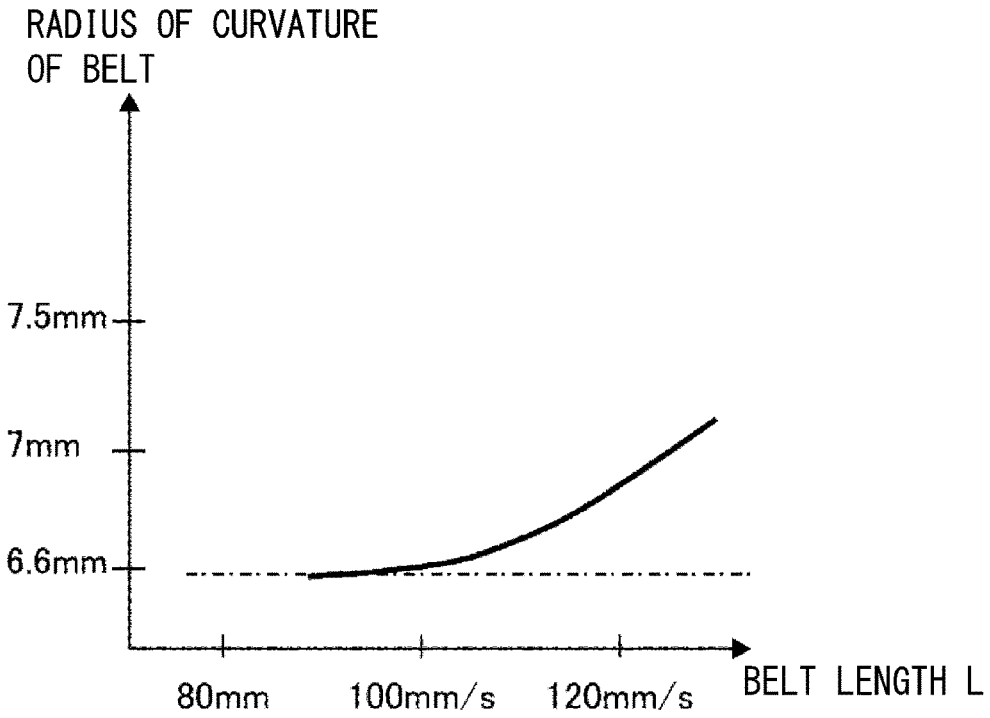
FIG. 7 is a graph showing a relationship between the belt length L and a radius of curvature of the fixing belt.

A second embodiment will be described using FIGS. 5 to 7. In the above-described first embodiment, with respect to the rotational direction of the fixing belt 310, the auxiliary driving roller 340 was disposed on the side downstream of the stretching roller 351 and upstream of the fixing pad 320. On the other hand, in this embodiment, with respect to the rotational direction of the fixing belt 310, the auxiliary driving roller 340 is disposed on a side downstream of the fixing pad 320 and upstream of the stretching roller 351. Specifically, in this embodiment, compared with the constitution of the first embodiment, the positions of the auxiliary driving roller 340 and the stretching roller 351 is changed to each other. Other constitutions and functions are similar to those of the first embodiment, and therefore, redundant constituent elements are represented by the same reference numerals or symbols and will be omitted from description and illustration or briefly described. In the following, a difference from the first embodiment will be principally described.

A fixing device 8A of this embodiment is different from the fixing device 8 of the first embodiment in structure of a heating unit 300A in the first embodiment. Specifically, as described above, with respect to the rotational direction of the fixing belt 310, the auxiliary driving roller 340 is disposed on the side downstream of the fixing pad 320 and upstream of the stretching roller 351. Further, between the fixing pad 320 and the auxiliary driving roller 340, a member stretching the fixing belt 310 is not disposed. That is, as regards the heating unit 300A, as shown in FIG. 5, from the outlet of the nip N with respect to the recording material feeding direction, with respect to the rotational direction of the fixing belt 310, the auxiliary driving roller 340 and the stretching roller 351 are disposed in a named order, so that this order is the reverse of the order in the constitution of the first embodiment. In the case of this embodiment, by disposing the auxiliary driving roller 340 at a position closer to the nip N, the belt followability can be further improved. This will be described using FIGS. 6 to 11.

[Relationship Between Belt Length and Feeding Effect of Auxiliary Driving Roller]

Depending on which one of the auxiliary driving rollers 340 and the stretching roller 351 is disposed on the upstream side with respect to the rotational direction, a belt length from the outlet of the nip N with respect to the feeding direction to the auxiliary driving roller 340 varies. FIG. 6 is a schematic view for illustrating the belt length L. The belt length L refers to a distance from a point required for the belt followability to a point of action of the force. In this embodiment, a length from the curved surface shape portion 320*b* (the outlet of the nip N) which is the downstream end of the fixing pad 320 to the auxiliary driving roller 340 is the belt length L.

The present inventors conducted a simple test for observing how the belt followability changes when the belt length L is changed. A result of the simple test is shown in FIG. 7. In the simple test, the belt followability was observed when an angle θ formed between the nip surface and the locus of the fixing belt 310 is 52° and the fixing belt 310 is pulled with a force of 50 N while changing the belt length L. From FIG. 7, it is understood that shortening of the belt length L leads to improvement in belt followability. This would be considered that a difference is belt followability is caused by the influences of the rigidity of the base layer of the fixing belt 310, contraction of the parting layer of the fixing belt 310, and the like.

The constitution of the second embodiment in such that the fixing pad 320 and the auxiliary driving roller 340 are disposed adjacent to each other. For that reason, a belt length L between the fixing pad 320 and the auxiliary driving roller 340 with respect to a direction opposite to the rotational direction of the fixing belt 310 is shorter than a belt length between the fixing pad 320 and the auxiliary driving roller 340 with respect to the direction opposite to the rotational direction of the fixing belt 310 in the first embodiment. For that reason, when the constitution of the second embodiment is employed, even when the peripheral speed of the auxiliary driving roller 340 is made slow, a degree of expansion of the fixing belt 310 in the neighborhood of the outlet of the nip can be made small.

Thus, in the case of the constitution of this embodiment, even when the peripheral speed of the auxiliary driving roller 340 is made slower than the peripheral speed of the auxiliary driving roller 340 in the constitution of the first embodiment, the belt followability can be improved, so that a lowering in separation property of the recording material from the fixing belt 310 can be suppressed. Further, the fixing belt 310 can be made hard to contact the separation member 400. Further, the peripheral speed of the auxiliary driving roller 340 can be made slow, and therefore, abrasion due to friction between the fixing belt 310 and the auxiliary driving roller 340 can be reduced. However, also in this embodiment, in the case where the belt followability and thermal conductivity from the auxiliary driving roller 340 to the fixing belt 310 are taken into consideration, the peripheral speed of the auxiliary driving roller 340 may preferably be made faster than the peripheral speed of the pressing roller 330.

Figure 5:
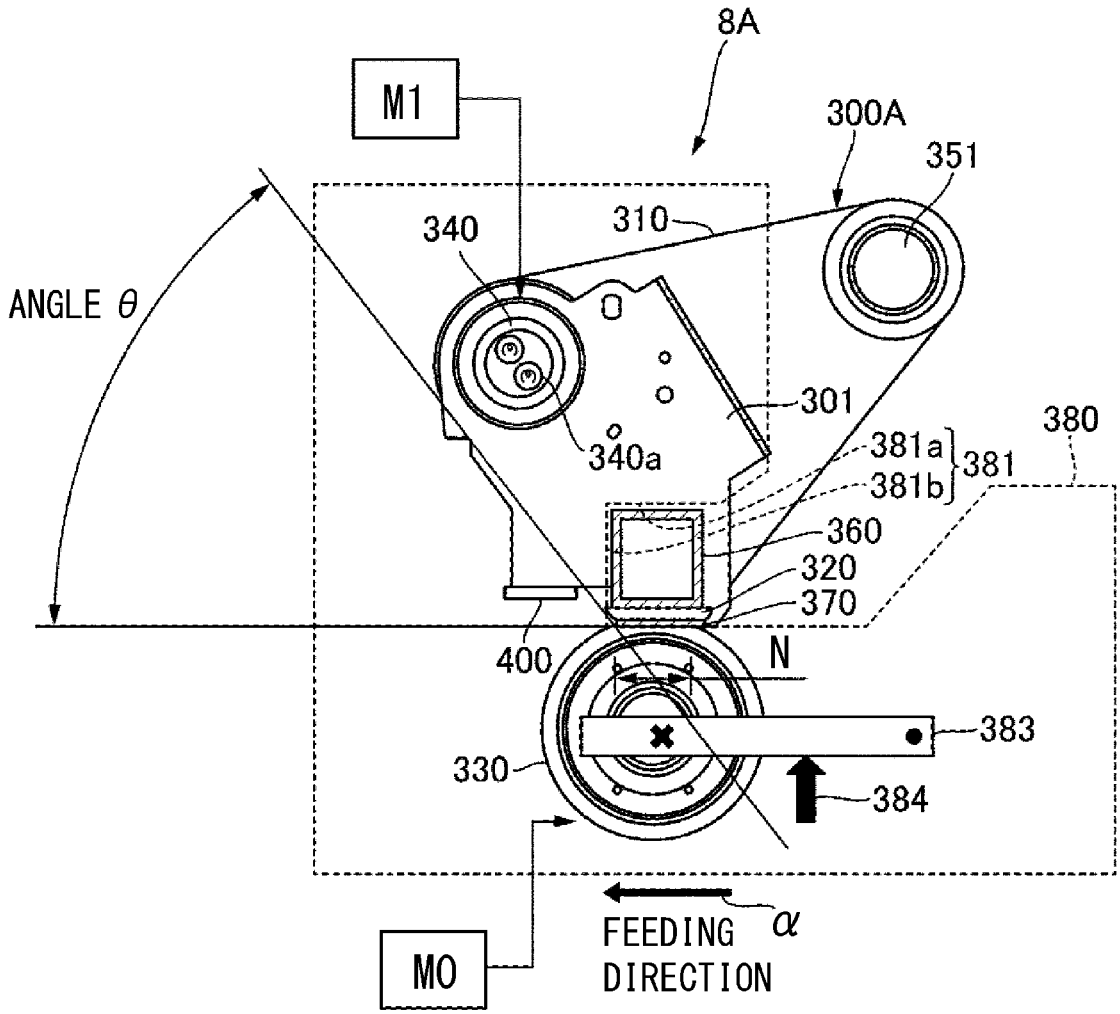
FIG. 5 is a schematic sectional view of a fixing device according to a second embodiment.

Incidentally, in the embodiment shown in FIG. 5, inside the fixing belt 310, the auxiliary driving roller 340 was disposed without providing no member on a side downstream of the nip N. However, when a member which does not contribute to stretch of the fixing belt 310, such as a cleaning member or a member for applying a lubricant is employed, there is no particular problem even when such a member is disposed between the nip N and the auxiliary driving roller 340.

Third Embodiment

A third embodiment will be described using FIG. 8. In this embodiment, the stretching roller 351 in the above-described second embodiment is changed to a steering roller 350. Other constitutions and functions are similar to those of the second embodiment, and therefore, redundant constituent elements are represented by the same reference numerals or symbols and will be omitted from description and illustration or briefly described. In the following, a difference from the second embodiment will be principally described.

Figure 8:
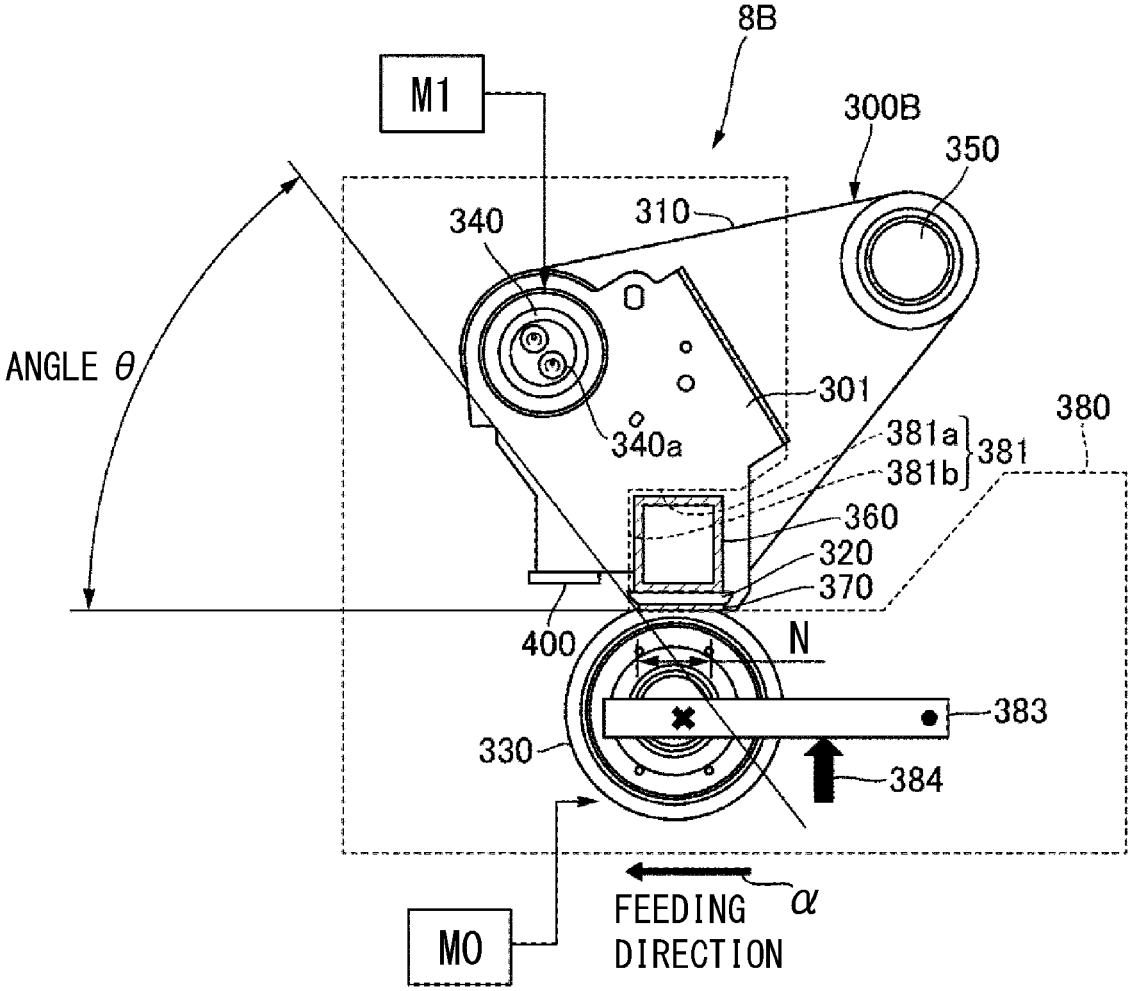
FIG. 8 is a schematic sectional view of a fixing device according to a third embodiment.

As shown in FIG. 8, a fixing device 8B of this embodiment is different from the fixing device 8 of the first embodiment in structure of a heating unit 300B in the second embodiment. Specifically, a stretching roller, provided inside the fixing belt 310, for stretching the fixing belt 310 in cooperation with the fixing pad 320 and the auxiliary driving roller 340. Incidentally, also in the case of this embodiment, with respect to the rotational direction of the fixing belt 310, the auxiliary driving roller 340 is disposed on a side downstream of the fixing pad 320 and the steering roller 350.

The steering roller 350 is tilted relative to a rotational axis direction (longitudinal direction) of the auxiliary driving roller 340, and thus controls a position (shift position) of the fixing belt 310 with respect to this rotational axis direction. That is, the steering roller 350 includes a rotation center in the center of the steering roller 350 with respect to the rotational axis direction and swings about this rotation center, so that the steering roller 350 tilts with respect to the longitudinal direction of the auxiliary driving roller 340. By this, a difference in tension is generated between one side and the other side of the fixing belt 310 with respect to the longitudinal direction, so that the fixing belt 310 is moved in the longitudinal direction.

The fixing belt 310 shifts to either one of opposite end portions thereof during rotation due to outer diameter accuracy of the roller for stretching the fixing belt 310 and alignment accuracy between the respective rollers. For this reason, the shift of the fixing belt 310 is controlled by the steering roller 350. Incidentally, the steering roller 350 may also be swung by a driving source such as a motor, or a constitution in which the fixing belt 310 is swung by self-alignment may also be employed. Further, the rotation center may be the center of the steering roller 350 with respect to the longitudinal direction as in this embodiment and may also be an end portion of the steering roller 350 with respect to the longitudinal direction.

Further, in the case of this embodiment, the steering roller 350 is also tension roller which is urged by a spring supported by a frame of the heating unit 300B and which imparts predetermined tension to the fixing belt 310. The tension applied to the spring is 50 N, and by applying the tension to the fixing belt 310, so that the fixing belt 310 is caused to follow the curved surface shape portions 320*a* and 320*b* of the fixing pad 320.

In the constitution of the third embodiment, from the outlet of the nip N with respect to the feeding direction, the auxiliary driving roller 340 and the steering roller 350 are disposed in a named order with respect to the rotational direction of the fixing belt 310. On the other hand, in a comparison example, from the outlet of the nip N with respect to the feeding direction, the steering roller 350 and the auxiliary driving roller 340 are disposed in a named order with respect to the rotational direction of the fixing belt 310. That is, the influence on the belt followability will be studied by making comparison between the case where the steering roller 350 is disposed upstream of the auxiliary driving roller 340 with respect to the rotational direction of the fixing belt 310 and the case where the steering roller 350 is disposed downstream of the auxiliary driving roller 340 with respect to the rotational direction of the fixing belt 310. When the steering roller 350 is disposed upstream of the auxiliary driving roller 340, at longitudinal end portions, the angle θ changes between one end portion and the other end portion by rotation (inclination) of the steering roller 350. As a result, with respect to the longitudinal direction, the distance of the fixing belt 310 from the outlet of the nip N to the auxiliary driving roller 340 causes non-uniformity with respect to the longitudinal direction, so that tension non-uniformity of the fixing belt 310 is liable to occur. Accordingly, as a result, an expansion amount of the fixing belt 310 is different between one end portion and the other end portion of the fixing belt 310 with respect to the longitudinal direction, and therefore, stability of the separation property lowers.

On the other hand, as in the third embodiment, by disposing the auxiliary driving roller 340 on the side upstream of the steering roller 350, the auxiliary driving force of the auxiliary driving roller 340 can be efficiently applied to the fixing belt 310 without non-uniformity. For this reason, the belt followability was able to be improved more than in the comparison example. For this reason, in the case of the third embodiment, it is possible to realize improvement of the separation property of the recording material from the fixing belt 310 and suppression of contact between the fixing belt 310 and the separation member 400.

Thus, in the case of the constitution of this embodiment, even when the stretching roller is changed to the steering roller 350, the belt followability can be improved, so that a lowering in separation property of the recording material from the fixing belt 310 can be suppressed. Further, the fixing belt 310 can be made hard to contact the separation member 400.

Fourth Embodiment

A fourth embodiment will be described using FIG. 9. In the above-described embodiments, the constitution in which as the nip forming member, the fixing pad 320 which is the non-rotatable member was used was described. On the other hand, in this embodiment, as the nip forming member, a roller (fixing roller 390) is used. Further, in this embodiment, different from the above-described embodiments, the fixing belt 310 is stretched only by the auxiliary driving roller 340 and the fixing roller 390. Other constitutions and functions are similar to those of the first embodiment, and therefore, redundant constituent elements are represented by the same reference numerals or symbols and will be omitted from description and illustration or briefly described. In the following, a difference from the first embodiment will be principally described.

Figure 9:
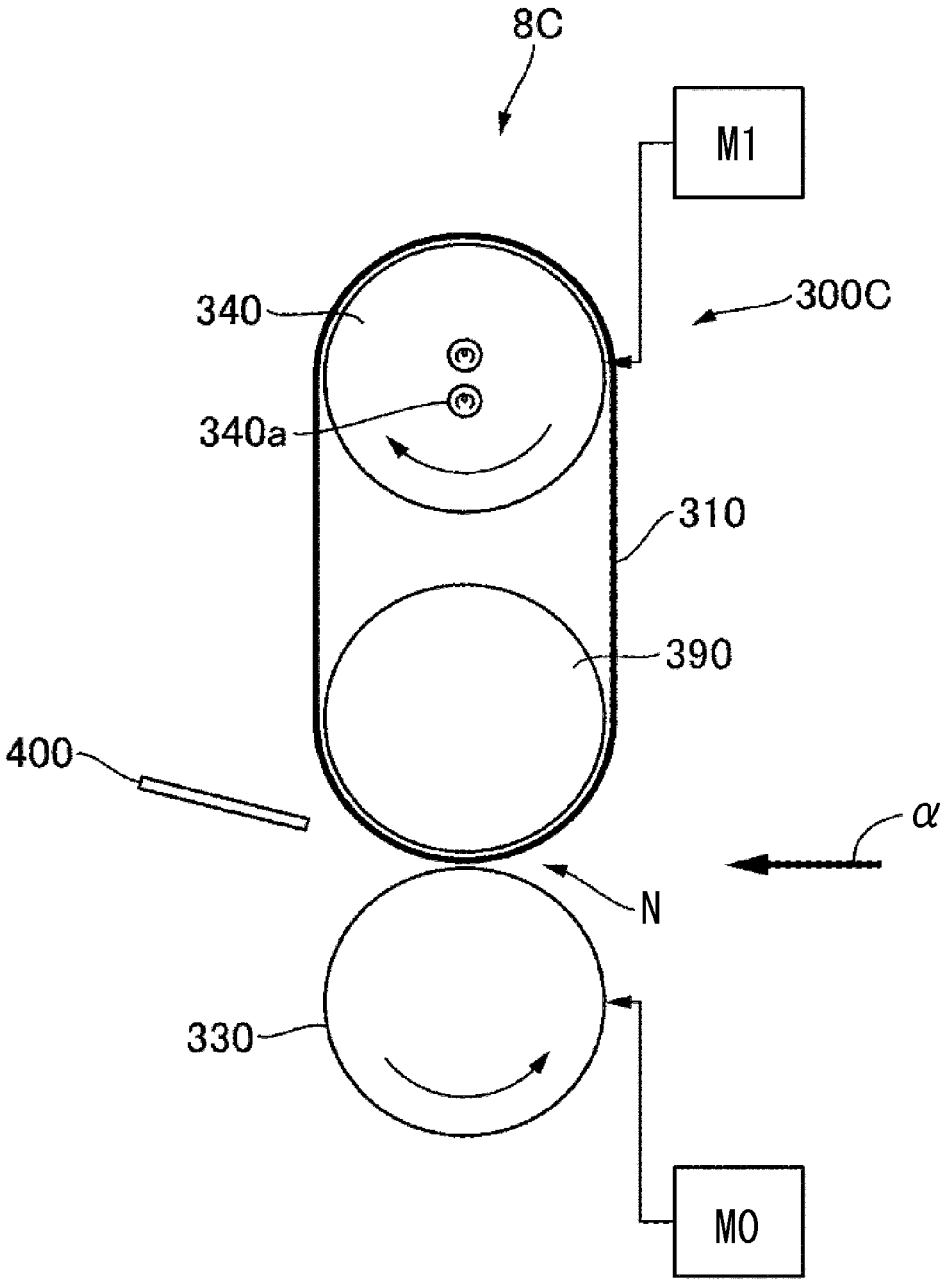
FIG. 9 is a schematic sectional view showing a principal portion of a fixing device according to a fourth embodiment.

As shown in FIG. 9, a heating unit 300C of a fixing device 8C stretches a fixing belt 310 only by the auxiliary driving roller 340 and the fixing roller 390.

The fixing roller 390 is not only disposed inside the fixing belt 310 so as to oppose the pressing roller 330 through the fixing belt 310, but also forms a nip N in which the recording material is nipped and fed between the fixing belt 310 and the pressing roller 330. The fixing roller 390 is rotated by the fixing belt 310.

Further, the fixing roller 390 is formed in a cylindrical shape, and therefore, similarly as in the case of the downstream curved surface shape portion 320*b* of the fixing pad 320, the fixing belt 310 is curved by the curvature of the downstream end portion of the nip N with respect to the recording material feeding direction. Further, the recording material passed through the nip N is separated from the fixing belt 310. For this reason, similarly as in the case where the nip forming member is the fixing pad 320, when the recording material separation property is taken into consideration, improvement in followability (belt followability) of the fixing belt 310 to the curvature of the fixing roller 390 is required.

That is, even when the nip forming member is a rotatable member such as the fixing roller 390, similarly as in the above-described embodiments, the fixing belt 310 rotates while being supplied with the fixing belt driving force from the pressing roller 330. For this reason, by the fixing belt driving force, the fixing belt 310 expands toward a downstream side of the feeding direction, so that there is a liability that the followability of the fixing belt 310 to the fixing roller 390 lowers.

Therefore, also in this embodiment, in order to satisfy the followability of the fixing belt 310 to the fixing roller 390, the auxiliary driving force is applied from the auxiliary driving roller 340 to the fixing belt 310. In this embodiment, the auxiliary driving roller 340 is disposed on a side opposite from the pressing roller 330 with respect to the fixing roller 390.

Further, the auxiliary driving roller 340 is also tension roller which is urged by an unshown spring supported by a frame of the heating unit 300C and which imparts predetermined tension to the fixing belt 310. The tension applied to the spring is 50 N, and by applying the tension to the fixing belt 310, so that the fixing belt 310 is caused to follow an outer peripheral surface of the fixing roller 390.

Further, each of the auxiliary driving roller 340 and the fixing roller 390 is formed of a 1 mm-thick aluminum pipe, and a surface layer thereof is subjected to the anodization treatment. Incidentally, each of the auxiliary driving roller 340 and the fixing roller 390 may also be a roller made of another metal such as stainless steel. In the auxiliary driving roller 340, the halogen heater 340*a* as the heating source is provided and is capable of heating the auxiliary driving roller 340 up to a predetermined temperature. On the other hand, the fixing roller 390 is not provided with the heating source such as the halogen heater. Incidentally, the heating source may also be provided in the fixing roller 390 without being provided in the auxiliary driving roller 340, and may also be provided in both of the rollers.

Further, to the pressing roller 330, the rotational driving force is applied from the motor M0 as the pressing roller driving source, and to the auxiliary driving roller, the rotational driving force is applied from the motor M1 as the auxiliary driving roller driving source. However, rotation of the auxiliary driving roller 340 may also be realized by applying the rotational driving force thereto from the motor M0. Also, in the case of this embodiment, the peripheral speed of the auxiliary driving roller 340 may preferably be made faster than the peripheral speed of the pressing roller 330.

As described above, also in this embodiment, by providing the auxiliary driving roller 340, the belt followability can be improved. As a result, a lowering in separation property of the recording material, passing through the nip N, from the fixing belt 310 can be suppressed, and the fixing belt 310 can be caused to less contact the separation member 400.

Fifth Embodiment

Figure 10:
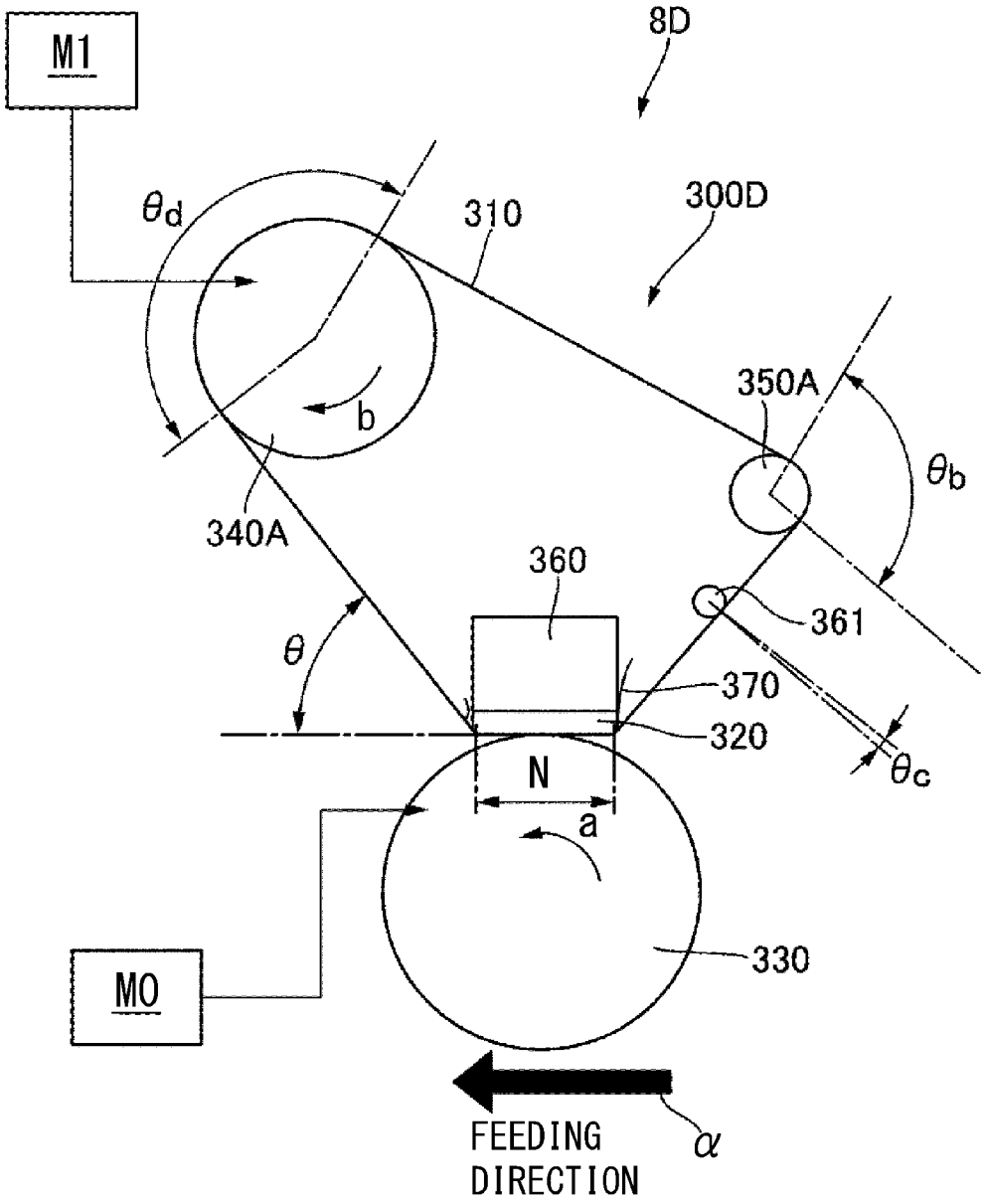
FIG. 10 is a schematic sectional view of a fixing device for illustrating a relationship between a winding amount of a fixing belt according to a fifth embodiment about a roller for stretching the fixing belt and a winding amount of the fixing belt about another roller for stretching the fixing belt.

A fifth embodiment will be described using FIG. 10. In this embodiment, the winding amount of the belt described with reference to FIG. 4 is made largest in the auxiliary driving roller 340 between the winding amounts of the rollers stretching the fixing belt 310. Further, in this embodiment, the steering roller 350A in either one of the above-described first to third embodiments is changed to a steering roller 350. Other constitutions and functions are similar to those of either one of the first to third embodiments, and therefore, redundant constituent elements are represented by the same reference numerals or symbols and will be omitted from description and illustration or briefly described. In the following, a difference from either one of the first to third embodiments will be principally described.

A fixing device 8D includes a heating unit 300D including the fixing belt 310 as an endless rotatable heating member, the fixing pad 320 as the nip forming member, the auxiliary driving roller 340A and the steering roller 350, and includes the pressing roller 330. Incidentally, also in the case of this embodiment, with respect to the rotational direction of the fixing belt 310, the auxiliary driving roller 340A is disposed on a side downstream of the fixing pad 320 and the steering roller 350A.

The fixing belt 310 has a thin cylindrical shape of 120 mm in inner diameter, and a basic structure thereof is similar to the contents described in the third embodiment, and is stretched by the fixing pad 320, the auxiliary driving roller 340 and the steering roller 350A. Further, the fixing belt 310 is pressed toward the fixing pad 320 by the pressing roller 330, and between the fixing pad 320 and the fixing belt 310, the lubrication sheet 370 is interposed.

Further, in the case of this embodiment, an oil application roller 361 as a lubricant application member for applying the lubricant onto the inner peripheral surface of the fixing belt 310 is provided. The oil application roller 361 is about 10 mm in outer diameter and is positioned inside the fixing belt 310 and between the fixing pad 320 and the steering roller 350A. The oil application roller 361 is supported by an unshown rotatable supporting arm so as to be urged against the inner peripheral surface of the fixing belt 310 with pressure of about 10 N.

Inside the oil application roller 361, a heat-resistant aramid felt impregnated with heat-resistant silicone oil which is used as the lubricant for lubricating the belt inner peripheral surface and which has viscosity of about 100 cSt is provided. Further, as a surface layer of the heat-resistant aramid felt, a sheet-like oil application control film consisting of a porous PTFE layer is used. This oil application roller 361 supplies the silicone oil to the inner peripheral surface of the fixing belt 310 while being rotated by movement of the rotating fixing belt 310 in contact with the inner peripheral surface of the fixing belt 310.

The auxiliary driving roller 340A is a 1.5 mm-thick aluminum pipe of 80 mm in outer diameter, and an unshown halogen heater is provided inside the auxiliary driving roller 340A and is capable of heating the auxiliary driving roller 340A up to a predetermined temperature. The fixing belt 310 is heated by the auxiliary driving roller 340A and is controlled at a predetermined target temperature depending on a kind of the recording material, on the basis of temperature detection by a thermistor. To the auxiliary driving roller 340A, a gear is fixed at one end portion of a shaft, and through the gear, the auxiliary driving roller 340A is connected to the motor M1 and is rotationally driven in an arrow b direction.

Further, also in this embodiment, the auxiliary driving roller 340A is driven at a peripheral speed faster than the peripheral speed of the fixing belt 310. Specifically, driving forces of the motor M0 for driving the pressing roller 330 and the motor M1 so that the auxiliary driving roller 340A is driven at the peripheral speed of 357 mm/s and that the fixing belt 310 is driven at the peripheral speed of 340 mm/s. At this time, between the auxiliary driving roller 340A and the fixing belt 310 different in peripheral speed, the silicone oil which is a viscous liquid interposed and absorbs a difference in peripheral speed between the inner peripheral surface of the fixing belt 310 and the surface of the auxiliary driving roller 340A. Further, by friction and a shearing force of the viscous liquid, the auxiliary driving force is transmitted from the auxiliary driving roller 340A to the fixing belt 310.

With higher dynamic viscosity, a transmission effect of the auxiliary driving force more increases. However, in order to ensure also smooth sliding between the fixing belt 310 and the fixing pad 320, the dynamic viscosity of the lubricant at a normal temperature (20° C.) may desirably be smaller than 10000 $mm^2/s$. Further, when the viscosity is excessively small, a degree of slip between the fixing belt 310 and the auxiliary driving roller 340A becomes large, and the auxiliary driving force cannot be sufficiently transmitted, and therefore, the dynamic viscosity of the lubricant at the normal temperature (20° C.) may desirably be 50 $mm^2/s$ or more.

The steering roller 350A is a 1 mm-thick aluminum pipe of 20 mm in outer diameter, and end portions thereof are rotationally supported by unshown bearings. Further, the steering roller 350A is also tension roller which is urged by a spring supported by a frame of the heating unit 300D and which imparts predetermined tension to the fixing belt 310. Further, for example, the tension applied to the spring is 50 N, and by applying the tension to the fixing belt 310, so that the fixing belt 310 is caused to follow the curved surface shape portions 320*a* and 320*b* of the fixing pad 320. Such a structure of the steering roller 350A is similar to the structure of the steering roller 350 in the third embodiment.

Incidentally, each of the surface layers of the auxiliary driving roller 340A and the steering roller 350A is subjected to the anodization treatment. However, each of the auxiliary driving roller 340A and the steering roller 350A may also be a roller made of another metal such as stainless steel.

The pressing roller 330 is constituted similarly as in the first embodiment and is connected to the motor M0, and is rotationally driven in the arrow a direction. Further, in the nip N formed between the fixing belt 310 and the pressing roller 330, the toner image is heated while nipping and feeding the recording material on which the toner image is carried.

[Winding Amount of Fixing Belt]

Here, an angle formed on the basis of a roller center by winding the fixing belt 310 about the auxiliary driving roller 340A is a winding angle θd. Further, angles formed on the basis of roller centers by winding the fixing belt 310 about the steering roller 350A and the oil application roller 361 are winding angles θb and θc. Further, the angle θ between the nip surface and the locus of the fixing belt 310 from the nip N to the auxiliary driving roller 340A is 52° similarly as in the first embodiment.

At this time, the auxiliary driving roller 340A and the steering roller 350A are disposed so that the winding angle θd by the auxiliary driving roller 340A is 150° and that the winding angle θb b the steering roller 350A is 100°. Further, the winding angle θd by the auxiliary driving roller 340A is made larger than each of the winding angles θb and θc by the stretching members other than the auxiliary driving roller 340A (θd>θb, θd>θc). That is, the winding angle θd by the auxiliary driving roller 340A is made larger than the winding angle θb by the steering roller 350A and the winding angle θc by the oil application roller 361.

Further, in this embodiment, a cross-sectional area of the auxiliary driving roller 340A is made larger than cross-sectional areas of the steering roller 350A and the oil application roller 361. That is, in the case where the fixing belt 310 is stretched by a plurality of members, the cross-sectional area of the member for auxiliary drive (i.e., the auxiliary driving roller 340A) of the stretching members is made largest, and in addition, the winding angle θd of the fixing belt 310 about the member for auxiliary drive is made large.

By this, belt arrangement capable of largely ensuring a proportion of winding of the belt about the auxiliary driving roller 340A can be effectively realized. That is, a constitution in which the winding angle of the fixing belt 310 about the auxiliary driving roller 340A can be made larger than the winding angle of the fixing belt 310 about each of the steering roller 350A and the oil application roller 361 can be employed with reliability.

As a result, the auxiliary driving force can be efficiently transmitted from the auxiliary driving roller 340A to the fixing belt 310. Further, in the case where the heating source such as the halogen heater is provided inside the auxiliary driving roller 340A, heat transfer efficiency from the auxiliary driving roller 340A to the fixing belt 310 can also be improved. Further, on the inner peripheral surface of the fixing belt 310 onto which the silicone oil which is the viscous liquid as the lubricant is applied, a contact area between the auxiliary driving roller 340A and the fixing belt 310 can be largely ensured and therefore, a transmission effect of the auxiliary driving force by a shearing force can be largely ensured.

Sixth Embodiment

Figure 11:
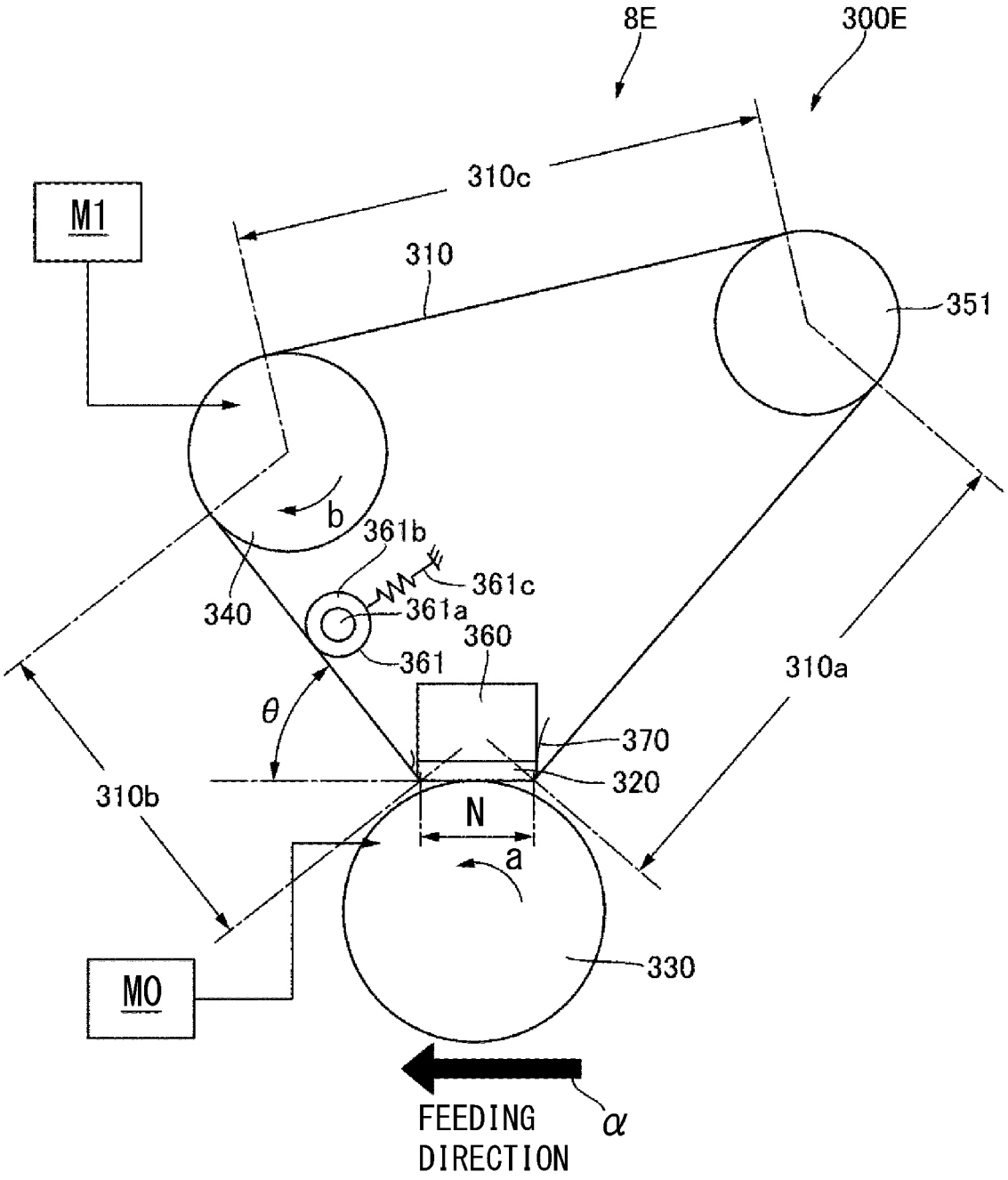
FIG. 11 is a schematic sectional view showing a principal portion of a fixing device according to a sixth embodiment.
Figure 12:
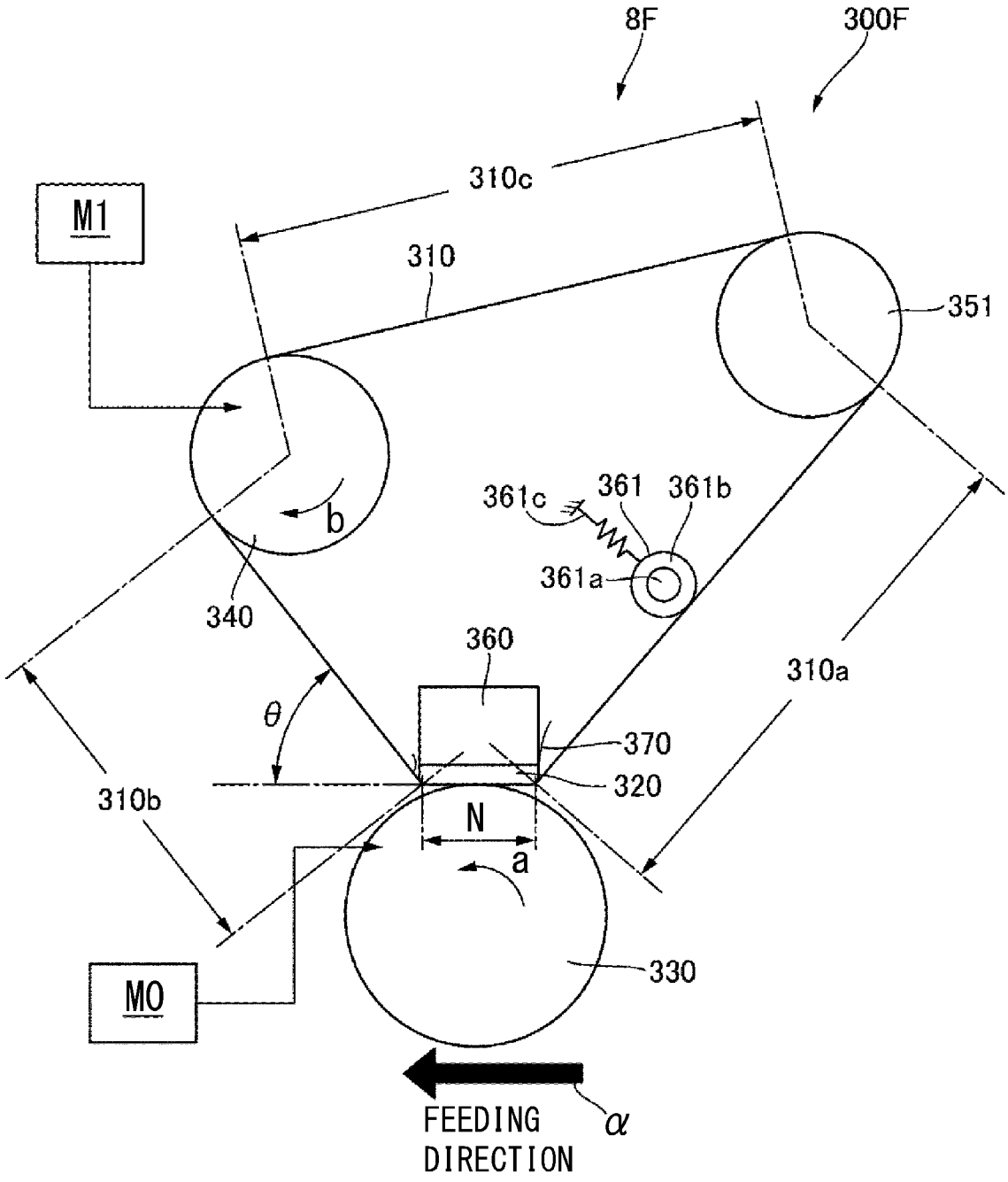
FIG. 12 is a schematic sectional view showing a principal portion of a fixing device according to a first example of the sixth embodiment.
Figure 13:
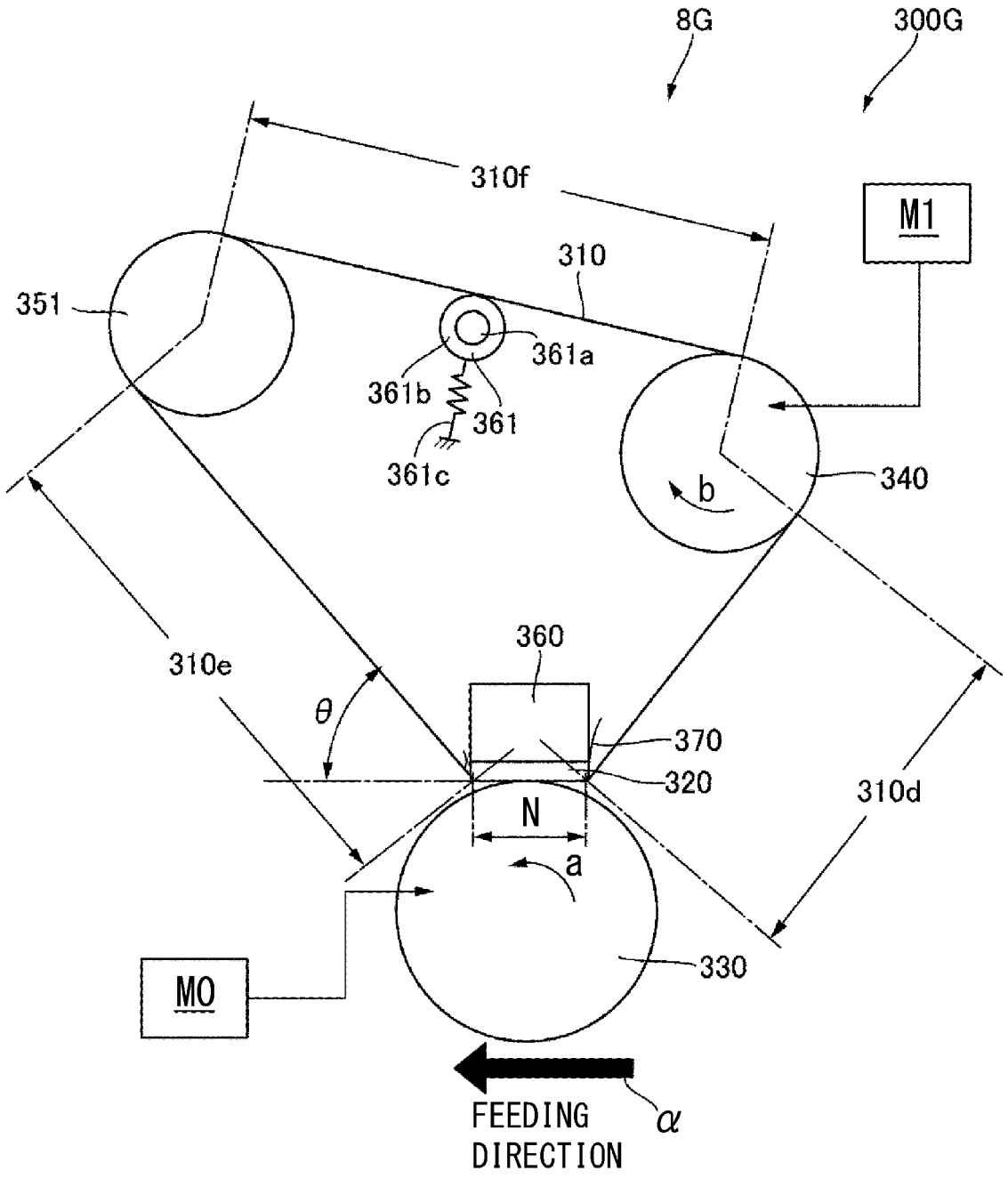
FIG. 13 is a schematic sectional view showing a principal portion of a fixing device according to a second example of the sixth embodiment.
Figure 14:
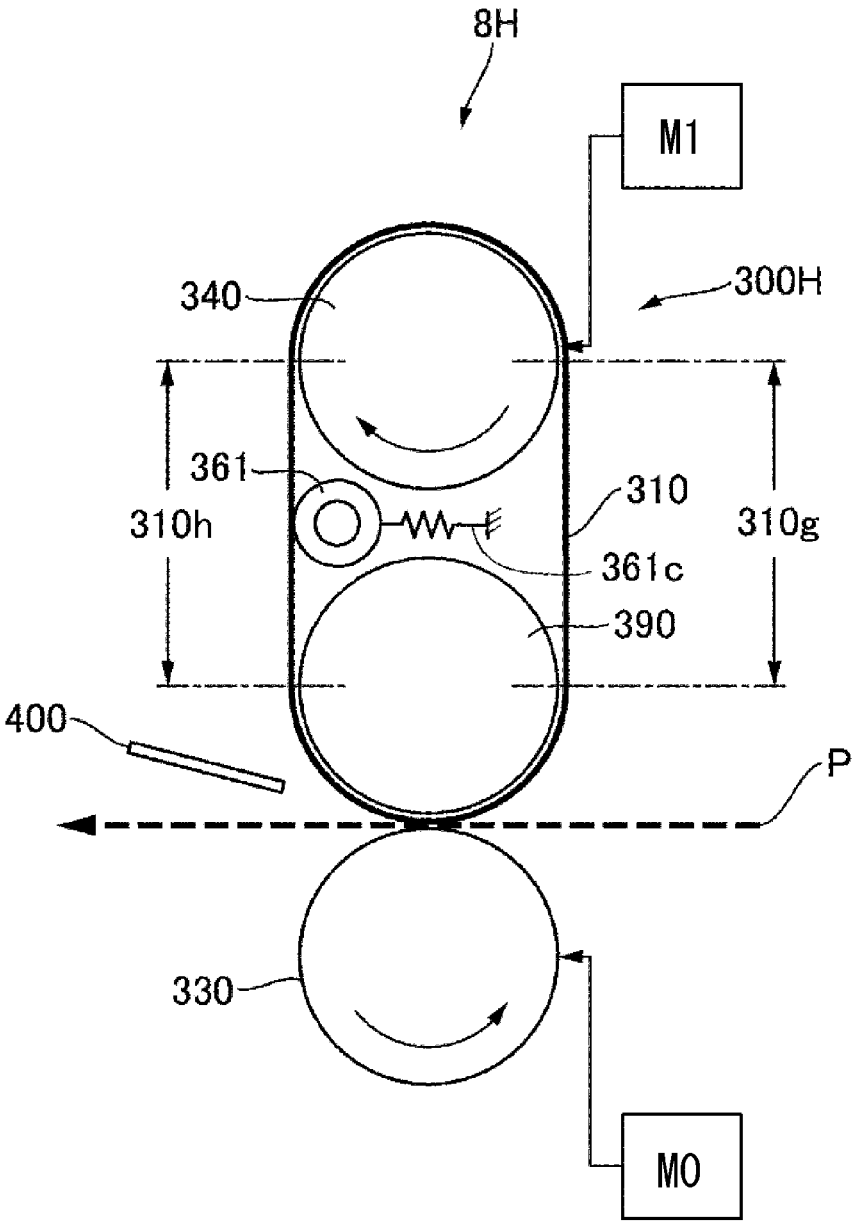
FIG. 14 is a schematic sectional view showing a principal portion of a fixing device according to a third example of the sixth embodiment.

A sixth embodiment will be described using FIGS. 11 to 14. This embodiment relates to the arrangement of the oil application roller 361 described in the fifth embodiment. As regards FIG. 11 and FIG. 12 showing a first example (another example) of this embodiment, constitutions thereof are similar to the constitution of the second embodiment except that the oil application roller 361 is provided. As regard FIG. 13 showing a second example of this embodiment, a constitution thereof is similar to the constitution of the first embodiment except that the oil application roller 361 is provided. As regards FIG. 14 showing a third example of this embodiment, a constitution thereof is similar to the constitution of the fourth embodiment except that the oil application roller 361 is provided. Accordingly, redundant constituent elements in each of the figures, are represented by the same reference numerals or symbols and will be omitted from description and illustration or briefly described. In the following, a difference from the first, second, fourth and fifth embodiments will be principally described.

First, also in the case of this embodiment, similarly as in the fifth embodiment, the oil application roller 361 as a lubricant application member for applying the lubricant onto the inner peripheral surface of the fixing belt 310 is provided. As a material of the oil application roller 361, it is possible to cite, for example, organic or inorganic porous materials such as a sponge and porous ceramics and materials prepared by winding organic or inorganic woven or nonwoven fabrics about a shaft, and the like. These materials are impregnated with the lubricant in advance, and the lubricant is applied onto the inner peripheral surface of the fixing belt 310 by being exuded little by little.

The oil application roller 361 contacts the inner peripheral surface of the fixing belt 310 in a state in which the oil application roller 361 is urged toward the inner peripheral surface of the fixing belt 310 by a compression spring 361*c* as an urging means. The urging means may also be an elastic member such as a tension spring, a leaf spring or a rubber, other than the compression spring. However, the position of the oil application roller 361 may also be fixed at a position contacting the inner peripheral surface of the fixing belt 310. In this embodiment, the oil application roller 361 as the lubricant application member is a rotatable member but may also be a non-rotatable member. For example, a member such as a pad or a sponge impregnated with the lubricant may also be contacted to the inner peripheral surface of the fixing belt 310.

Further, the oil application roller 361 comprises a shaft 361*a* and a lubricant retention layer 361*b*. As a material of the shaft 361*a*, for example, it is possible to cite aluminum, iron, stainless steel, brass and the like. The lubricant retention layer 361*b* is a layer impregnated with the lubricant to be applied and in which the lubricant is retained, and the lubricant with which the layer is impregnated exudes from this layer, so that the lubricant is applied onto the inner peripheral surface of the fixing belt 310. As the material of the lubricant retention layer 361*b*, as described above, the porous material or the fiber material is used. An amount of the lubricant for impregnation is 3.6 g in this embodiment.

Here, when a contact force (or a contact pressure) of the oil application roller 361 to the inner peripheral surface of the fixing belt 310 is not stabilized, there is a liability that excess and deficiency of an application amount of the lubricant occur. For example, in the case where the application amount of the lubricant is excessively large, the lubricant in the oil application roller 361 is exhausted early. Further, in the case where the application amount of the lubricant is excessively small, a sliding property between the inner peripheral surface of the fixing belt 310 and the member contacting the inner peripheral surface of the fixing belt 310 lowers.

As a factor in fluctuation of the contact force of the oil application roller 361 to the fixing belt 310, it is possible to cite that vibration generating during rotation of the fixing belt 310 acts in a direction of lowering belt tension. For this reason, in this embodiment, the oil application roller 361 is contacted to the inner peripheral surface of the fixing belt 310 pulled by the auxiliary driving roller 340 or the pressing roller 330, whereby the fluctuation of the contact force of the oil application roller 361 is suppressed. The contact force of the oil application roller 361 to the fixing belt 310 is set at 2 N or more and 3.2 N or less correspondingly to a lubricant application amount per 100 hours of 0.7 g or more and 1.2 g or less. In the fixing device 8 of this embodiment, a target value of the contact force was determined at 2.6 N.

Specifically, in the case of a fixing device 8E shown in FIG. 11, the oil application roller 361 is disposed upstream of the auxiliary driving roller 340 and downstream of the fixing pad 320 with respect to the rotational direction of the fixing belt 310. Here, a heating unit 300E of the fixing device 8E includes sections 310*a*, 310*b* and 310*c* in which the fixing belt 310 is stretched between adjacent stretching members. The section 310*a* is positioned between the steering roller 351 and the fixing pad 320. The section 310*b* is positioned between the fixing pad 320 and the auxiliary driving roller 340. The section 310*c* is positioned between the auxiliary driving roller 340 and the stretching roller 351. Incidentally, when belt lengths of the sections 310*a* and 310*b* are compared with each other, the belt length of the section 310*b* is short.

In this case, in this embodiment, the oil application roller 361 is contacted to the inner peripheral surface of the fixing belt 310 in the section 310*b* which is a range in which the fixing belt 310 is stretched by the auxiliary driving roller 340 and the fixing pad 320. By this, the oil application roller 361 is contacted to the inner peripheral surface of the fixing belt 310 pulled by the auxiliary driving roller 340, and therefore, the fluctuation of the contact force is suppressed.

Next, in the case of a fixing device 8E shown in FIG. 12 showing the first example (another example), the oil application roller 361 is disposed upstream of the fixing pad 320 and downstream of the stretching roller 351 with respect to the rotational direction of the fixing belt 310. In a heating unit 300F of the fixing device 8F, sections 310*a*, 310*b* and 310*c* are the same as those shown in FIG. 11.

In this case, in this embodiment, the oil application roller 361 is contacted to the inner peripheral surface of the fixing belt 310 in the section 310*a* which is a range in which the fixing belt 310 is stretched by the fixing pad 320 and the stretching roller 351. By this, the oil application roller 361 is contacted to the inner peripheral surface of the fixing belt 310 pulled by the pressing roller 330, and therefore, the fluctuation of the contact force is suppressed.

Next, in the case of a heating unit 300G of a fixing device 8G shown in FIG. 13 showing the second example, compared with the constitutions of FIG. 11 and FIG. 12, the positions of the auxiliary driving roller 340 and the stretching roller 351 are changed to each other. For this reason, the oil application roller 361 is disposed upstream of the auxiliary driving roller 340 and downstream of the stretching roller 351 with respect to the rotational direction of the fixing belt 310. The heating unit 300G of the fixing device 8E includes sections 310*d*, 310*e* and 310*f* in which the fixing belt 310 is stretched between adjacent stretching members. The section 310*d* is positioned between the auxiliary driving roller 340 and the fixing pad 320. The section 310*e* is positioned between the fixing pad 320 and the stretching roller 351. The section 310*f* is positioned between the stretching roller 351 and the auxiliary driving roller 340.

In this case, in this embodiment, the oil application roller 361 is contacted to the inner peripheral surface of the fixing belt 310 in the section 310*f* which is a range in which the fixing belt 310 is stretched by the auxiliary driving roller 340 and the stretching roller 351. By this, the oil application roller 361 is contacted to the inner peripheral surface of the fixing belt 310 pulled by the auxiliary driving roller 340, and therefore, the fluctuation of the contact force is suppressed.

Incidentally, in the case the constitutions of FIGS. 11 to 13, this is true for the case where the stretching roller 351 is replaced with another stretching member such as the steering roller 350 for stretching the fixing belt 310.

Further, in the case of a fixing device 8H shown in FIG. 14, showing the third example, the oil application roller 361 is disposed upstream of the auxiliary driving roller 340 and downstream of the fixing roller 390 with respect to the rotational direction of the fixing belt 310. A heating unit 300H of the fixing device 8H includes sections 310*g* and 310*h* in which the fixing belt 310 is stretched between stretching members. With respect to the rotational direction of the fixing belt 310, the section 310*g* a range downstream of the auxiliary driving roller 340 and upstream of the fixing roller 390, and the section 310*h* is a range downstream of the fixing roller 390 and upstream of the auxiliary driving roller 340.

In this case, in this embodiment, the oil application roller 361 is contacted to the inner peripheral surface of the fixing belt 310 in the section 310*h* which is a range upstream of the auxiliary driving roller 340 and in which the fixing belt 310 is stretched by the auxiliary driving roller 340 and the fixing roller 390. By this, the oil application roller 361 is contacted to the inner peripheral surface of the fixing belt 310 pulled by the auxiliary driving roller 340, and therefore, the fluctuation of the contact force is suppressed.

Also, in either of the constitution, the fluctuation of the contact force of the oil application roller 361 to the fixing belt 310 is suppressed, and therefore, an application amount of the lubricant onto the fixing belt 310 by the oil application roller 361 can be established.

Seventh Embodiment

Figure 15:
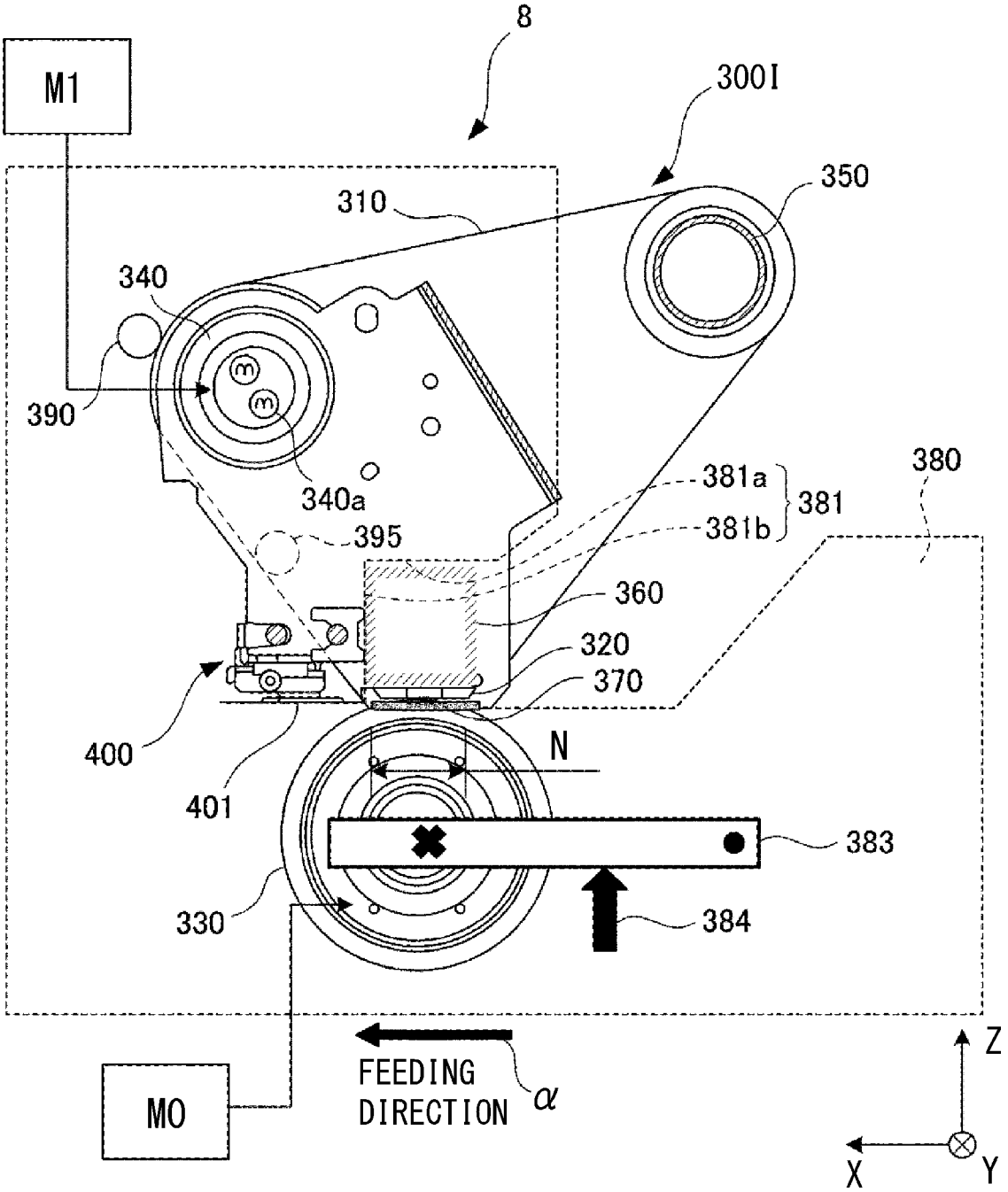
FIG. 15 is a schematic sectional view of a fixing device according to a seventh embodiment.

A seventh embodiment will be described using FIG. 15. This embodiment relates to arrangement of a refresh roller 390 for rubbing the fixing belt 310. This embodiment is similar to the second embodiment except that the refresh roller 390 is provided.

[Refresh Roller]

In the case of a heating unit 300I constituting a fixing device 8I of this embodiment, in order to stably maintain the outer peripheral surface of the fixing belt 310 in a desired state, the refresh roller 390 as a rotatable member contacting the outer peripheral surface of the fixing belt 310 and rotatably by being supplied with a driving force without through the fixing belt 310 is provided. In the case of this embodiment, the refresh roller 390 is driven by the motor M1 for driving the auxiliary driving roller 340.

Further, the refresh roller 390 is a rubbing roller for rubbing the outer peripheral surface of the fixing belt 310. Here, when recording materials such as various kinds of paper are continuously passed through the nip N, the surface of the fixing belt 310 has non-uniform roughness. When a fixing operation is carried out in this state, there is a liability that a surface state of the fixing belt 310 is transferred onto the toner image during passing of the recording material on which the toner image is carried and desired feeding of glossiness cannot be obtained in the toner image (output image) after the fixation and thus uneven glossiness occurs. Therefore, a surface property of the fixing belt 310 is adjusted by rubbing the surface of the fixing belt 310 with the refresh roller 390 through periodical contact of the refresh roller 390 with the outer peripheral surface of the fixing belt 310, so that the uneven glossiness of the output image can be made inconspicuous.

As the refresh roller 390, a roller which is made of stainless steel in an outer diameter of 12 mm and to which surface an abrasion grain material of an aluminum oxide system is bonded was used. As the refresh roller 390, a roller to which silicon oxide, titanium oxide, iron oxide, chromium oxide or the like is bonded, or a stainless-steel roller having an uneven surface subjected to blasting may also be used. Surface roughness of the refresh roller 390 may preferably be about 0.1-0.2 μm in terms of arithmetic average roughness Ra, and when the surface of the refresh roller 390 is roughened to a degree more than this range, the surface of the fixing belt 310 is damaged seriously, so that the output image is influenced.

Further, the refresh roller 390 is press-contacted to the outer peripheral surface of the fixing belt 310 with predetermined pressure by an unshown pressing mechanism for the fixing belt 310. Further, the refresh roller 390 is rotationally driven with a peripheral speed difference between itself and the fixing belt 310. In this embodiment, a peripheral speed V1 of the refresh roller 390 is made slower than a peripheral speed V0 of the fixing belt 310 (V1<V0). However, V1>V0 may also be satisfied. The refresh roller 390 is thus contacted to the outer peripheral surface of the fixing belt 310, whereby a surface layer of the fixing belt 310 can be finely scarred.

Incidentally, the pressing mechanism for pressing the refresh roller 390 controls press-contact and separation thereof relative to the fixing belt 310 by an unshown pressing spring and cam. The refresh roller 390 is freely fixed to the pressing mechanism at one end portion and the other end portion thereof with respect to a widthwise direction of the fixing belt 310. The pressure at which the refresh roller 390 is press-contacted to the fixing belt 310 in this embodiment is set at about 40 N in total.

The refresh roller 390 capable of moving toward and away from the outer peripheral surface of the fixing belt 310 is on standby at a separation position in general. Further, the refresh roller 390 is controlled so as to perform a surface rubbing operation of the fixing belt 310 by being press-contacted to the fixing belt 310 when needed, such as every time when a predetermined number of sheets of recording materials pass through the nip N.

In this embodiment, in order to provide the above-described peripheral speed difference, the refresh roller 390 is subjected to independent drive control by a motor (for example, the motor M1) different from the motor M0 for driving the pressing roller 330. Further, as another driving method for driving the refresh roller 390, a method in which the refresh roller 390 is connected to the motor M1 by a gear with a peripheral speed ratio to the pressing roller 330 and a rotational speed of the refresh roller 390 may also be switched by a clutch. In the image forming apparatus in this embodiment, in order to effectively roughen the surface of the fixing belt 310, the peripheral speed of the refresh roller 390 was 100 mm/s.

Further, in the case of this embodiment, the refresh roller 390 is disposed at a position opposing the auxiliary driving roller 340 through the fixing belt 310. In other words, the refresh roller 390 is contacted to the outer peripheral surface of the fixing belt 310 stretched by the auxiliary driving roller 340.

Further, in other words, the following is satisfied. First, on the fixing belt 310, with respect to the feeding direction, the outlet of the nip N is defined as an upstream side, and an inlet of the nip N is defined as a downstream side. When a plurality of members are contacted to the fixing belt 310, upstream and downstream positions are defined on the basis of a point where the auxiliary driving roller 340 contacts the fixing belt 310. For example, the point where the auxiliary driving roller 340 contacts, the fixing belt 310 is positioned on the belt upstream of a point where the predetermined 390 contacts the fixing belt 310. Therefore, the refresh roller 390 is positioned downstream of the point on the upstream side where the auxiliary driving roller starts to contact the fixing belt 310.

[Followability of Fixing Belt to Curved Surface Shape Portion of Fixing Pad]

As shown in FIG. 3, in the constitution of this embodiment, an angle θ between the nip surface and a locus of the fixing belt 310 from the nip N to the stretching roller 351 is 52°. Here, in the case rigidity of the fixing belt 310 is small and tension applied to the fixing belt 310 is sufficiently large, a locus in the neighborhood of an outlet (on a side downstream of the nip N with respect to the recording material feeding direction) of the nip N of the fixing belt 310 is as shown by a solid line in FIG. 3. However, by the rigidity of the fixing belt 310 and the force received by the fixing belt 310 in the nip N, there is a liability that the locus of the fixing belt 310 in the neighborhood of the outlet of the nip N during the image formation expands as shown by a broken line of FIG. 3.

That is, the fixing belt 310 receives the rotational driving force from the pressing roller 330. For this reason, if in the case where the above-described auxiliary driving roller 340 is a roller which does not impart the driving force to the fixing belt 310, there is a liability that the fixing belt 310 is flexed by the driving force of the pressing roller 330 in the neighborhood of the outlet of the nip N. In this case, followability of the fixing belt 310 to the curvature of the curved surface shape portion 320*b* at the downstream end portion of the fixing pad 320 lowers, so that the fixing belt 310 is not sufficiently curved at the outlet of the nip N, and thus the locus of the fixing belt 310 expands as indicated by the broken line of FIG. 3. That is, behavior of the fixing belt 310 becomes unstable.

In this way, when the locus of the fixing belt 310 expands in the neighborhood of the outlet of the nip N, a separation property of the recording material from the fixing belt 310 lowers. Further, there is also a possibility that the fixing belt 310 and the separation member 401 (FIG. 15) disposed close to the fixing belt 310 contact each other. When the fixing belt 310 contacts the separation member 401, there is a liability that the surface of the fixing belt 310 is scarred and a quality of the toner image fixed by the fixing device 8 lowers.

As a solution for solving such a problem, it would be considered that the tension of the fixing belt 310 is made large. However, in the case where the tension of the fixing belt 310 is made large, there is a liability that an adverse effect such as creep deformation of the base layer of the fixing belt 310 is caused. Herein, the followability of the fixing belt 310 to the curved surface shape portion 320*b* is referred to as the belt followability.

In this embodiment, as described above, the auxiliary driving roller 340 which is disposed inside the fixing belt 310 and which imparts (applies) the driving force to the fixing belt 310 is provided. Particularly, in this embodiment, a peripheral speed of the auxiliary driving roller 340 is made faster than a peripheral speed of the pressing roller 330. Thus, when the peripheral speed of the auxiliary driving roller 340 is made faster than the peripheral speed of the pressing roller 330, tension generates on the downstream side of the nip with respect to the feeding direction of the fixing belt 310, so that the fixing belt 310 becomes easy to follow the fixing pad 320.

In the same principle, in the case where the refresh roller 390 is contacted to the fixing belt 390, the fixing belt 310 receives the driving force from the refresh roller 390. For this reason, when the refresh roller 390 is contacted to the fixing belt 310, the belt followability changes. Here, to the fixing belt 310, the refresh roller 390 is contacted, for example, at a position upstream of the auxiliary driving roller 340 and downstream of the fixing pad 320, on the belt followability, the refresh roller 390 has a larger influence than the auxiliary driving roller 340 has. Particularly, in the case where the refresh roller 390 is contacted to the fixing belt 310 between the auxiliary driving roller 340 and the fixing pad 320 and where the peripheral speed of the refresh roller 390 is made slower than the peripheral speed of the fixing belt 310, the belt followability lowers.

Therefore, in this embodiment, the refresh roller 390 is disposed at a position opposing the auxiliary driving roller 340 through the fixing belt 310. By this, the auxiliary driving roller 340 has a larger influence on the belt followability than the auxiliary driving roller 340 has, so that a lowering in belt followability can be suppressed. That is, it is possible to suppress that the fixing belt 310 is not sufficiently curved in the outlet of the nip N and the locus thereof expands as indicated by a broken line of FIG. 3. That is, in the constitution in which separately from the auxiliary driving roller 340, the refresh roller 390 to which the driving force is applied is provided, the behavior of the fixing belt 310 can be stabilized.

Eighth Embodiment

Figure 16:
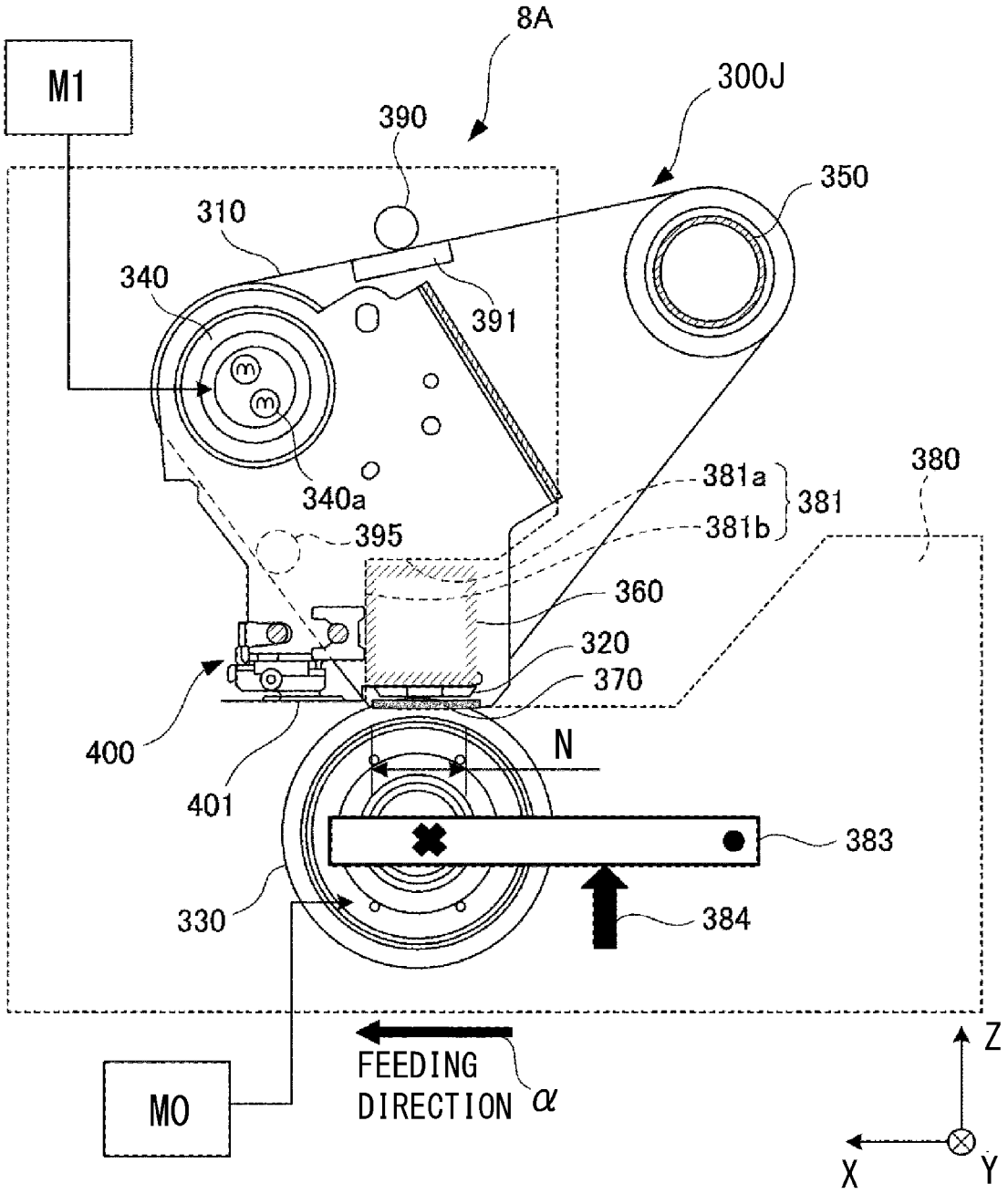
FIG. 16 is a schematic sectional view of a fixing device according to an eighth embodiment.

An eighth embodiment will be described using FIG. 16. This embodiment is different from the above-described seventh embodiment in position of the refresh roller 390. Other constitutions and functions are similar to those of the seventh embodiment, and therefore, similar constituent elements are represented by the same reference numerals or symbols and will be omitted from description and illustration or briefly described. In the following, a difference from the seventh embodiment will be principally described.

In the case of a heating unit 300J constituting a fixing device 8A, with respect to the rotational direction of the fixing belt 310, the refresh roller 390 is disposed downstream of the auxiliary driving roller 340 and upstream of the fixing pad 320. Particularly in this embodiment, with respect to the rotational direction of the fixing belt 310, the refresh roller 390 is disposed downstream of the auxiliary driving roller 340 and upstream of the steering roller 350. That is, a position where the refresh roller 390 contacts the outer peripheral surface of the fixing belt 310 is between the auxiliary driving roller 340 and the steering roller 350.

Of the inner peripheral surface of the fixing belt 310, at a position opposing the refresh roller 390 through the fixing belt 310, a back-up member 391 is provided. With respect to the widthwise direction of the fixing belt 310, one end portion and the other end portion of the back-up member 391 are fixed to corresponding portions of the fixing frame 380. An outer peripheral surface of the back-up member 391 is formed in a shape following the inner peripheral surface of the fixing belt 310 in a free state. Further, at the surface of the back-up member 391, as an elastic layer, a 2 mm-thick silicone rubber is provided so as to contact the inner peripheral surface of the fixing belt 310.

In the case of this embodiment as described above, the refresh roller 390 is disposed on a side downstream of the auxiliary driving roller 340. For this reason, similarly as in the seventh embodiment, the auxiliary driving roller 340 has a larger influence on the belt followability than the refresh roller 390 has, so that a lowering in belt followability can be suppressed.

Incidentally, the refresh roller 390 may also be disposed between the steering roller 350 and the fixing pad 320. Also, in this case, at a position opposing the refresh roller 390 through the fixing belt 310, the back-up member 391 is provided. Further, the refresh roller 390 may also be disposed at a position opposing the steering roller through the fixing belt 310. In this case, a constitution in which the refresh roller 390 swings in interrelation with the steering roller 350 may also be employed. However, in the case where the refresh roller 390 is provided at this position, a constitution in which the opposing stretching roller does not swing may preferably be employed.

Further, in the case where the refresh roller 390 opposes the stretching roller stretching the fixing belt 310, including the seventh embodiment, the refresh roller 390 is backed up by the stretching roller, and therefore, the above-described back-up member 391 can be omitted.

Comparison Example

Figure 17:
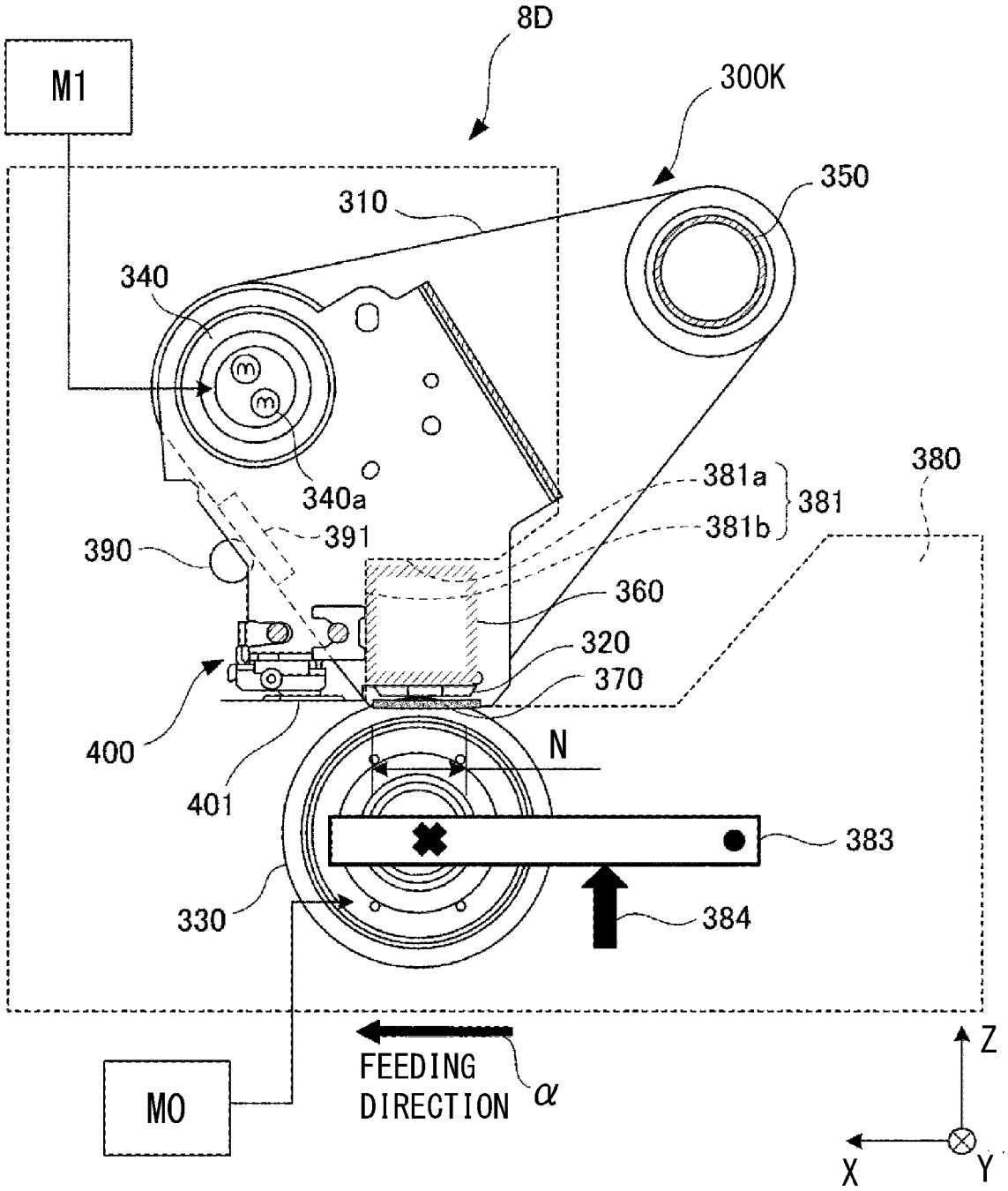
FIG. 17 is a schematic sectional view of a fixing device according to a comparison example.

Next, a comparison example to be compared with the above-described embodiments will be described using FIG. 17. FIG. 17 shows the comparison example. Further, the comparison example is set so that a basic constitution is the same as the basic constitution of the seventh embodiment. A heating unit 300K of a fixing device 8E of the comparison example is different from the fixing device of the seventh embodiment in position of a refresh roller 390. The position of the refresh roller 390 in the comparison example is on a side downstream of the fixing pad 320 and upstream of the auxiliary driving roller 340 with respect to the rotational direction of the fixing belt 310. Further, similarly as in the eighth embodiment, a back-up member 391 is provided at a position opposing the refresh roller 390 through the fixing belt 310.

[Confirmation of Effect]

The effects of the seventh and eighth embodiments will be described by comparing the seventh and eighth embodiments with the above-described comparison example.

In the case where the refresh roller 390 is disposed between the fixing pad 320 and the auxiliary driving roller 340 (comparison example), it turned out that the belt followability is impaired by the refresh roller 390. As the reason therefor, it is possible to cite that as a result of the arrangement of the refresh roller 390 and the back-up member 391 disposed so as to sandwich the fixing belt 310, an effect of pulling the belt surface by the auxiliary driving roller 340 does not reach the nip N.

On the other hand, in the seventh and eighth embodiments, the driving force can be ensured by disposing the refresh roller 390 at the position opposing the auxiliary driving roller 340 through the fixing belt 310 or disposing the refresh roller 390 on the side downstream of the auxiliary driving roller 340.

Other Embodiments

In the above-described embodiments, the constitution in which the auxiliary driving roller is provided with the halogen heater as the heating source for heating the fixing belt was described. However, the heating source may also be provided in the stretching roller or the steering roller without being provided in the auxiliary driving roller. Further, the heating source may also be provided in the nip forming member. For example, in the case where the nip forming member is the fixing pad, a plate-like heating member such as a ceramic heater may also be provided on the fixing belt side of the fixing pad. Further, in the case where the nip forming member is a roller, the heating source such as the halogen heater may also be provided in this roller. Further, a constitution in which the fixing belt is heated through electromagnetic induction heating may also be employed.

Further, in the above-described embodiments, the constitution in which the pressing surface is used as the rotatable driving member was described. However, the rotatable driving member may also be an endless belt which is stretched by a plurality of stretching rollers and which is driven by either one of the stretching rollers. Further, in the above-described embodiments, in order to form the nip, the pressing roller as the rotatable driving member is pressed against the belt, but a constitution in which the belt is pressed against the rotatable driving member may also be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2019-204986 filed on Nov. 12, 2019, 2019-204987 filed on Nov. 12, 2019 and 2020-037965 filed on Mar. 5, 2020, which are hereby incorporated by reference herein in their entirety.

What is claimed is:

1. A fixing device for fixing a toner image on a recording material, comprising:

a rotatable fixing belt configured to fix an unfixed toner image on the recording material in contact with the unfixed toner image formed on the recording material;

a pad provided inside said fixing belt;

a rotatable pressing member configured to press said fixing belt toward said pad so as to form a nip in which the recording material is nipped and fed;

a driving source configured to impart a driving force, for rotating said fixing belt, to said pressing member;

an auxiliary driving roller which is provided on a side downstream of the nip with respect to a rotational direction of said fixing belt and which stretches said fixing belt at an inner surface of said fixing belt without forming a nip in which the recording material is nipped and fed, wherein said auxiliary driving roller is configured to impart a driving force to said fixing belt;

a transmission mechanism configured to transmit the driving force from said driving source to said auxiliary driving roller, wherein a peripheral speed of said auxiliary driving roller is faster than a peripheral speed of said pressing member and a peripheral speed of said fixing belt; and a steering roller provided so as to stretch said fixing belt at the inner surface of said fixing belt in a position downstream of said auxiliary driving roller and upstream said pad with respect to a rotational direction of said fixing belt, wherein said steering roller is configured to adjust a position of said fixing belt with respect to a widthwise direction of said fixing belt by inclining said fixing belt so as to be positioned within a predetermined range.

2. A fixing device according to claim 1, wherein said transmission mechanism transmits, to said auxiliary driving roller, a driving force for making the peripheral speed of said fixing belt substantially equal to the peripheral speed of said pressing member.

3. A fixing device according to claim 1, wherein the following relationship is satisfied:

$$1.03 \leq (\text{peripheral speed of auxiliary driving roller})/(\text{peripheral speed of pressing member}) \leq 1.20.$$

4. A fixing device according to claim 1, further comprising a separating member provided with an interval from an outer peripheral surface of said fixing belt and configured to separate, from said fixing belt, the recording material passed through the nip.

5. A fixing device according to claim 1, further comprising a heating source provided inside said auxiliary driving roller and configured to heat said fixing belt.

6. A fixing device according to claim 1, wherein said auxiliary driving roller is made of aluminum, and a surface layer thereof is subjected to anodized treatment.

7. A fixing device according to claim 1, wherein a winding amount of said fixing belt about said auxiliary driving roller is larger than a winding amount of said fixing belt about said steering roller.

8. A fixing device according to claim 1, further comprising an application member contacting the inner surface of said fixing belt and configured to apply a lubricant onto said fixing belt.

9. A fixing device according to claim 8, wherein said application member is provided on a side downstream of said pad and upstream of said auxiliary driving roller with respect to the rotational direction of said fixing belt.

10. A fixing device according to claim 1, further comprising a sliding member contacting an outer surface of said fixing belt and configured to slide on said fixing belt.

11. A fixing device according to claim 10, wherein said sliding member presses said fixing belt toward said auxiliary driving roller.

12. A fixing device for fixing a toner image on a recording material, comprising:

a rotatable fixing belt configured to fix an unfixed toner image on the recording material in contact with the unfixed toner image formed on the recording material;

a pad provided inside said fixing belt;

a rotatable pressing member configured to press said fixing belt toward said pad so as to form a nip in which the recording material is nipped and fed;

a first driving source configured to impart a driving force, for rotating said fixing belt, to said pressing member;

an auxiliary driving roller which is provided on a side downstream of the nip with respect to a rotational direction of said fixing belt and which stretches said fixing belt at an inner surface of said fixing belt without forming a nip in which the recording material is nipped and fed, wherein said auxiliary driving roller is configured to impart a driving force to said fixing belt;

a second driving source configured to transmit a driving force to said auxiliary driving roller, wherein a peripheral speed of said auxiliary driving roller is faster than a peripheral speed of said pressing member and a peripheral speed of said fixing belt; and a steering roller provided so as to stretch said fixing belt at the inner surface of said fixing belt in a position downstream of said auxiliary driving roller and upstream said pad with respect to a rotational direction of said fixing belt, wherein said steering roller is configured to adjust a position of said fixing belt with respect to a widthwise direction of said fixing belt by inclining said fixing belt so as to be positioned within a predetermined range.

13. A fixing device according to claim 12, wherein said second driving source transmits, to said auxiliary driving roller, a driving force for making the peripheral speed of said fixing belt substantially equal to the peripheral speed of said pressing member.

14. A fixing device according to claim 12, wherein the following relationship is satisfied:

$$1.03 \leq (\text{peripheral speed of auxiliary driving roller})/(\text{peripheral speed of pressing member}) \leq 1.20.$$

15. A fixing device according to claim 12, further comprising a separating member provided with an interval from an outer peripheral surface of said fixing belt and configured to separate, from said fixing belt, the recording material passed through the nip.

16. A fixing device according to claim 12, further comprising a heating source provided inside said auxiliary driving roller and configured to heat said fixing belt.

17. A fixing device according to claim 12, wherein said auxiliary driving roller is made of aluminum, and a surface layer thereof is subjected to anodized treatment.

18. A fixing device according to claim 12, wherein a winding amount of said fixing belt about said auxiliary driving roller is larger than a winding amount of said fixing belt about said steering roller.

19. A fixing device according to claim 12, further comprising an application member contacting the inner surface of said fixing belt and configured to apply a lubricant onto said fixing belt.

20. A fixing device according to claim 18, wherein said application member is provided on a side downstream of said pad and upstream of said auxiliary driving roller with respect to the rotational direction of said fixing belt.

21. A fixing device according to claim 19, further comprising a sliding member contacting an outer surface of said fixing belt and configured to slide on said fixing belt.

22. A fixing device according to claim 21, wherein said sliding member presses said fixing belt toward said auxiliary driving roller.

23. A fixing device according to claim 1, wherein said pad is a substantially plate-like member long along the widthwise direction.

24. A fixing device according to claim 21, wherein said pad is a substantially plate-like member long along the widthwise direction.

* * * * *